US005836579A

United States Patent [19]

Hayashi et al.

[11] Patent Number: 5,836,579

[45] Date of Patent: Nov. 17, 1998

[54] SHEET POST-PROCESSING APPARATUS WITH STACK INCLINING MEANS

[75] Inventors: Kenichi Hayashi, Tokyo; Yoshifumi Takehara, Yokohama; Katsuhito Kato, Kawasaki, all of Japan

[73] Assignee: Canon Kabushiki Kaisha, Tokyo, Japan

[21] Appl. No.: 909,630

[22] Filed: Aug. 12, 1997

Related U.S. Application Data

[63] Continuation of Ser. No. 662,181, Jun. 12, 1996, abandoned, which is a continuation of Ser. No. 120,345, Sep. 14, 1993, abandoned.

[30] Foreign Application Priority Data

Sep. 17, 1992 [JP] Japan ..... 4-248006

[51] Int. Cl.[6] ..... B65H 39/11; G03G 15/001

[52] U.S. Cl. ..... 270/58.16; 270/58.18; 270/58.27; 270/58.28; 355/324

[58] Field of Search ..... 270/58.07, 58.14, 270/52.16, 52.17, 52.18, 52.27, 52.28; 355/323, 324; 271/213; 414/788.3, 789, 790.3

[56] References Cited

U.S. PATENT DOCUMENTS

| | | | |
|---|---|---|---|
| 3,774,906 | 11/1973 | Fagan et al. | 270/58 X |
| 4,015,724 | 4/1977 | Spencer | 414/788.3 |
| 4,208,122 | 6/1980 | Iwamoto et al. | 355/323 |
| 4,318,539 | 3/1982 | Lamos | 270/58 |
| 4,376,529 | 3/1983 | George et al. | 270/53 |
| 4,382,592 | 5/1983 | Harding et al. | 270/58 X |
| 4,852,868 | 8/1989 | Fukui et al. . | |
| 5,090,673 | 2/1992 | Kitahara et al. . | |

FOREIGN PATENT DOCUMENTS

| | | | |
|---|---|---|---|
| 002317 | 6/1979 | European Pat. Off. | 270/58 |
| 301595 | 2/1989 | European Pat. Off. . | |
| 423758 | 4/1991 | European Pat. Off. . | |
| 54-75761 | 6/1979 | Japan . | |
| 54-79635 | 6/1979 | Japan . | |
| 54-159966 | 12/1979 | Japan . | |
| 56-40146 | 3/1981 | Japan . | |
| 57-156957 | 9/1982 | Japan . | |
| 57-195064 | 11/1982 | Japan . | |
| 58-17063 | 2/1983 | Japan . | |
| 60-102364 | 6/1985 | Japan . | |
| 60-223764 | 11/1985 | Japan . | |
| 1-17754 | 1/1989 | Japan . | |
| 293259 | 12/1991 | Japan | 270/58 |

*Primary Examiner*—Hoang Nguyen
*Attorney, Agent, or Firm*—Fitzpatrick, Cella, Harper & Scinto

[57] ABSTRACT

A sheet post-processing apparatus includes at least one sheet receiving tray for accommodating sheets; a sheet discharger for discharging sheet to the sheet receiving tray; a sheet moving mechanism for moving the sheets on the sheet receiving tray inclinedly toward a front side of the apparatus.

41 Claims, 22 Drawing Sheets

SHEET POST-PROCESSING APPARATUS WITH STACK INCLINING MEANS

This application is a continuation of application Ser. No. 08/662,181, filed Jun. 12, 1996, which is a continuation of application Ser. No. 08/120,345, filed Sep. 14, 1993, both now abandoned.

FIELD OF THE INVENTION AND RELATED ART

The present invention relates to a sheet post-processing apparatus and an image forming apparatus having the same in which wherein the sheet post-processing apparatus is capable of accommodating and/or sorting on bin trays sheet materials such as copies discharged from an image forming apparatus such as a copying machine, a printer or a laser beam printer. The image forming apparatus in this specification may designate the image forming apparatus without the sheet post-processing apparatus and the image forming apparatus having the sheet post-processing apparatus, as the case may be.

FIG. 23 shows a conventional sheet post-processing apparatus J1 (movable bin type), in which the sheets discharged from an image forming apparatus J2 are sorted and accommodated. When the operator is taking the sheets out of the bin tray J3, it would be best to permit the operator to take it out in a direction X. However in the conventional apparatus, there are a reference plate J4, a stapler J5, a helical cam J6, an outer cover J7 or the like between the operator and the sheets, and therefore, it is not possible take the sheets out in the direction X. Therefore, the operator is required to move to the side end of the apparatus to retract the sheets in a direction Y. Therefore, an improvement in the operability is desired.

On the other hand, a conventional sheet post-processing apparatus (sorter) attached to the sheet discharge side of the image forming apparatus involves a limit in the number of bin trays, and therefore, it is not possible to sort and accommodate the number of sets of sheets which exceeds the number of bin trays. To solve this problem, the following proposals have been made.

(1) The sheets accommodated on a bin tray are moved onto another tray (for example, a stacking tray) by moving means, thus emptying the bin tray to permit to receive the further discharged sheets. By repeating the movement to the stacking tray, the number of sets of sheets exceeding the number of bin trays, can be processed.

(2) In a combination of a finisher having bin trays movable both in a direction perpendicular to the sheet discharging direction and a vertical direction and an automatic document feeder for automatically circulating originals, the bin tray position is shifted in the perpendicular direction for every one circulation of the documents (originals), thus providing offset between adjacent sheet sets, so that a plurality of sets of sheets can be accommodated on one bin tray.

(3) A plurality of sorters are connected, thus increasing the number of usable trays.

However, in the structure where the sheet sets can be taken out only from the lateral side of the apparatus, the operability is not good.

In the conventional structure described in (1) above, a stacking tray is required in addition to the bin trays with the result of bulkiness of apparatus. This is significant particularly when the image forming apparatus per se is small in size. The bulkiness of the apparatus leads to higher cost.

In the structure of above (2), the entire apparatus supporting the bin tray has to move with the result of complicated structure of the apparatus. In addition, the automatic document feeder has to circulate the originals for each set of copies. When the number of sets to be copied is large, the originals may be damaged.

With the structure (3), two, three or more sorters are connected in tandem, and therefore, larger space is required, and in addition, the cost is high.

SUMMARY OF THE INVENTION

Accordingly, it is a principal object of the present invention to provide a small size low cost sorter which is good in the operativity, and in addition, the number of sets of sheets exceeding the number of bin trays, can be sorted and accommodated.

According to an aspect of the present invention, there is provided a sheet post-processing apparatus comprising: at least one sheet receiving tray for accommodating sheets; sheet discharging means for discharging sheet to said sheet receiving tray; sheet moving means for moving the sheets on said sheet receiving tray inclinedly toward a front side of said apparatus.

According to a further aspect of the present invention, an additional improvement is that the sheets are received by the sheet receiving tray with offset, thus permitting to receive the number of sets exceeding the number of sheet receiving trays.

According to the present invention, after the sheets are sorted, the sheets on the sheet receiving trays are moved toward the operator (front side), circumventing the obstructing members of the apparatus such as a helical cam, a stapler, a cover or the like. Therefore, the operator can take the sheets out at the front side, thus improving the operativity. A plurality of sets of sheets can be accommodated with alignment on a single sheet receiving tray and the sorting and accommodating apparatus which is small and inexpensive can receive the number of sets of sheets exceeding the number of the sheet receiving trays.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
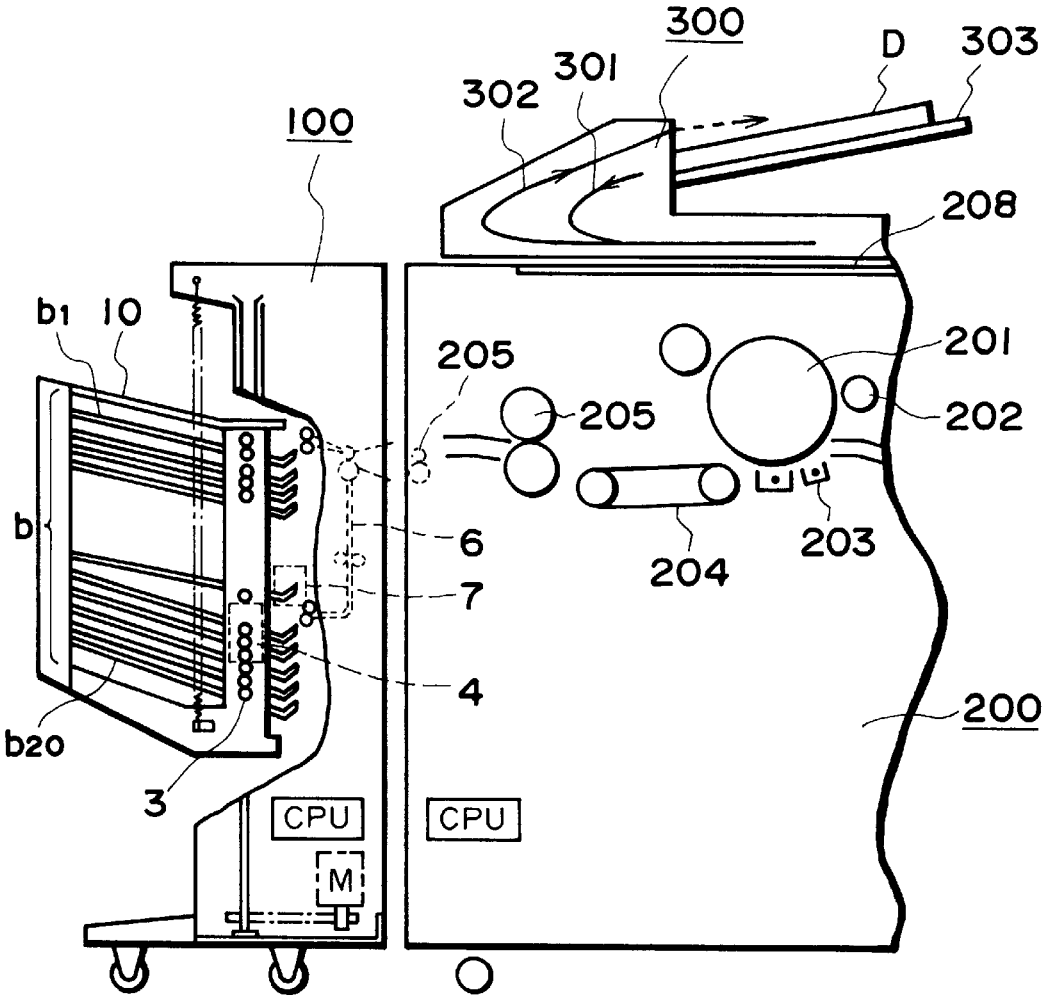
FIG. 1 is a sectional view of an apparatus according to an embodiment of the present invention.

FIG. 1 shows a general arrangement of a sheet post-processing apparatus 100, a main assembly 200 of an image forming apparatus and an automatic document feeder 300. As shown in this Figure, the automatic document feeder 300 for automatically circulating originals is disposed on top of the main assembly 200. To a downstream side of the main assembly, a sorter 100 having 20 bin trays b ($b_1$, $b_2$, . . . $b_{19}$, $B_{20}$) is attached. The main assembly of the image forming apparatus 200 uses a known electrophotographic process, and therefore, the detailed description of the image forming process is omitted for simplicity. An image of an original positioned on a platen glass 208 is projected onto a photosensitive drum 201 through an unshown optical system, so that an electrostatic latent image is formed. The latent image is developed by a developing device 202 adjacent to the photosensitive drum 201 into a toner image, which in turn is transferred by a transfer electrode 203 onto a sheet. The transferred image is fixed into a permanent image by a fixing device 205. The shown sorter 100 is of movable bin type in which the bin trays b arranged vertically are raised or lowered by one bin by one rotation of a helical cam 4 provided at each side.

Figure 2:
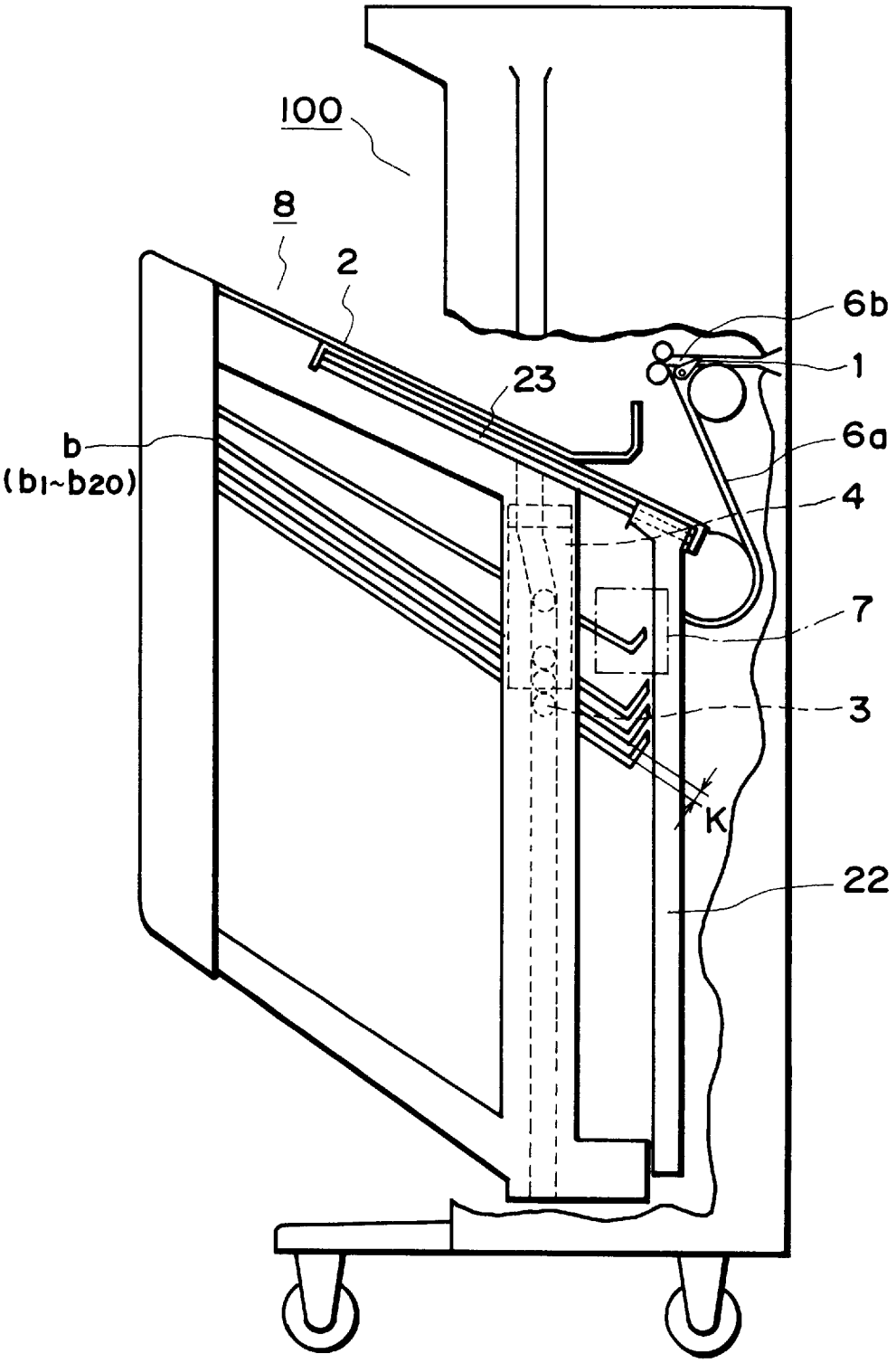
FIG. 2 is a sectional view of a sorter.

The sheet having been subjected to the image forming operation of the main assembly 200 is fed to the sorter 100 by discharging rollers 205, and is selectively fed to a sorting path 6*a* or to a non-sorting path 6*b* by a flapper 1 (FIG. 2). In the non-sorting mode, all the sheets are passed through the non-sorting path 6*b* with the flapper 1 taking the chain line position, and are discharged to a non-sorting tray 10. In the sorting mode, the sheets are passed through the sorting path 6*a* with the flapper 1 taking the solid line position, and the sheets are discharged by the discharging rollers and received by the bin trays which are synchronously moving up or down.

Figure 3:
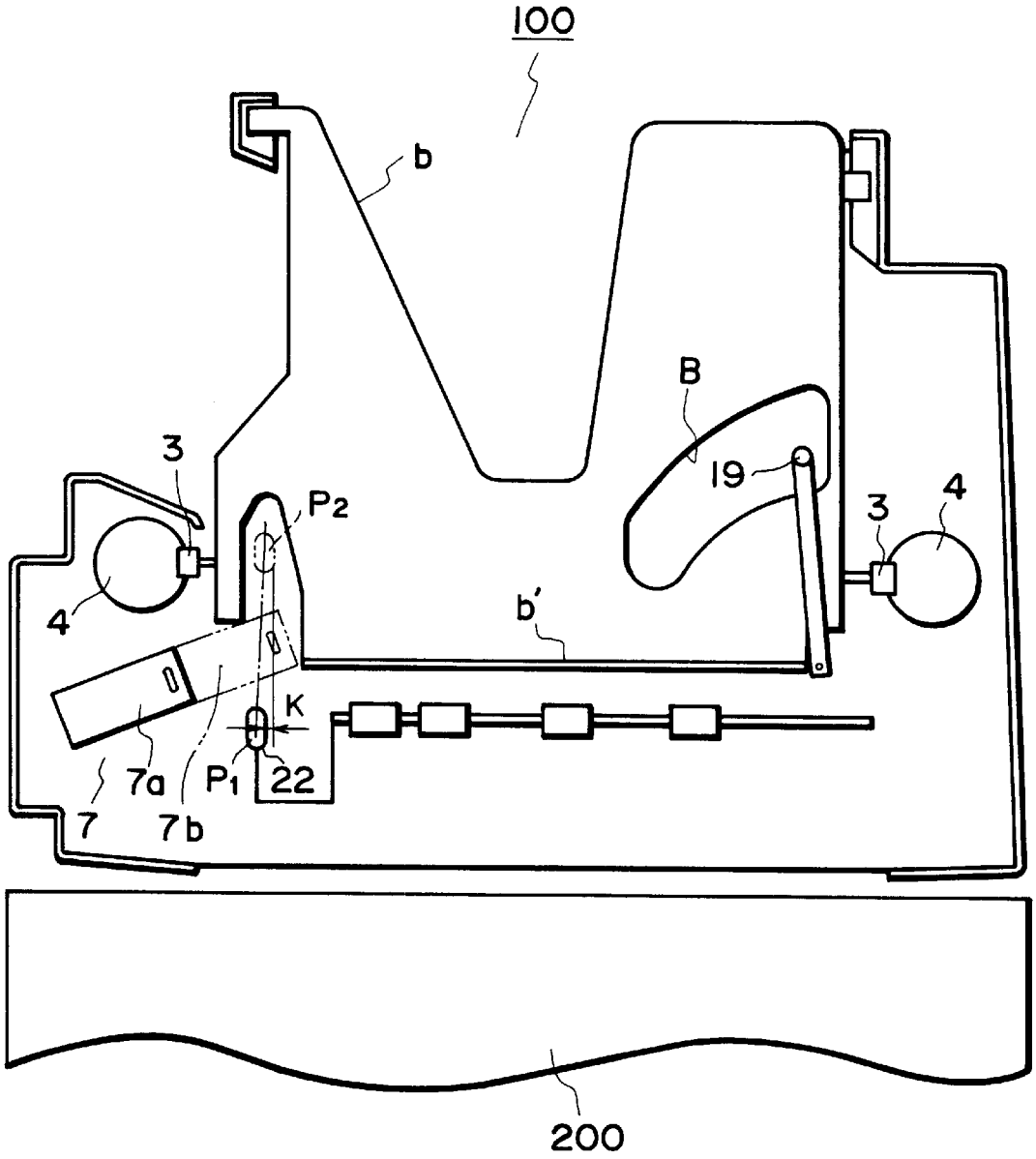
FIG. 3 is a top plan view of a sorter.
Figure 4:
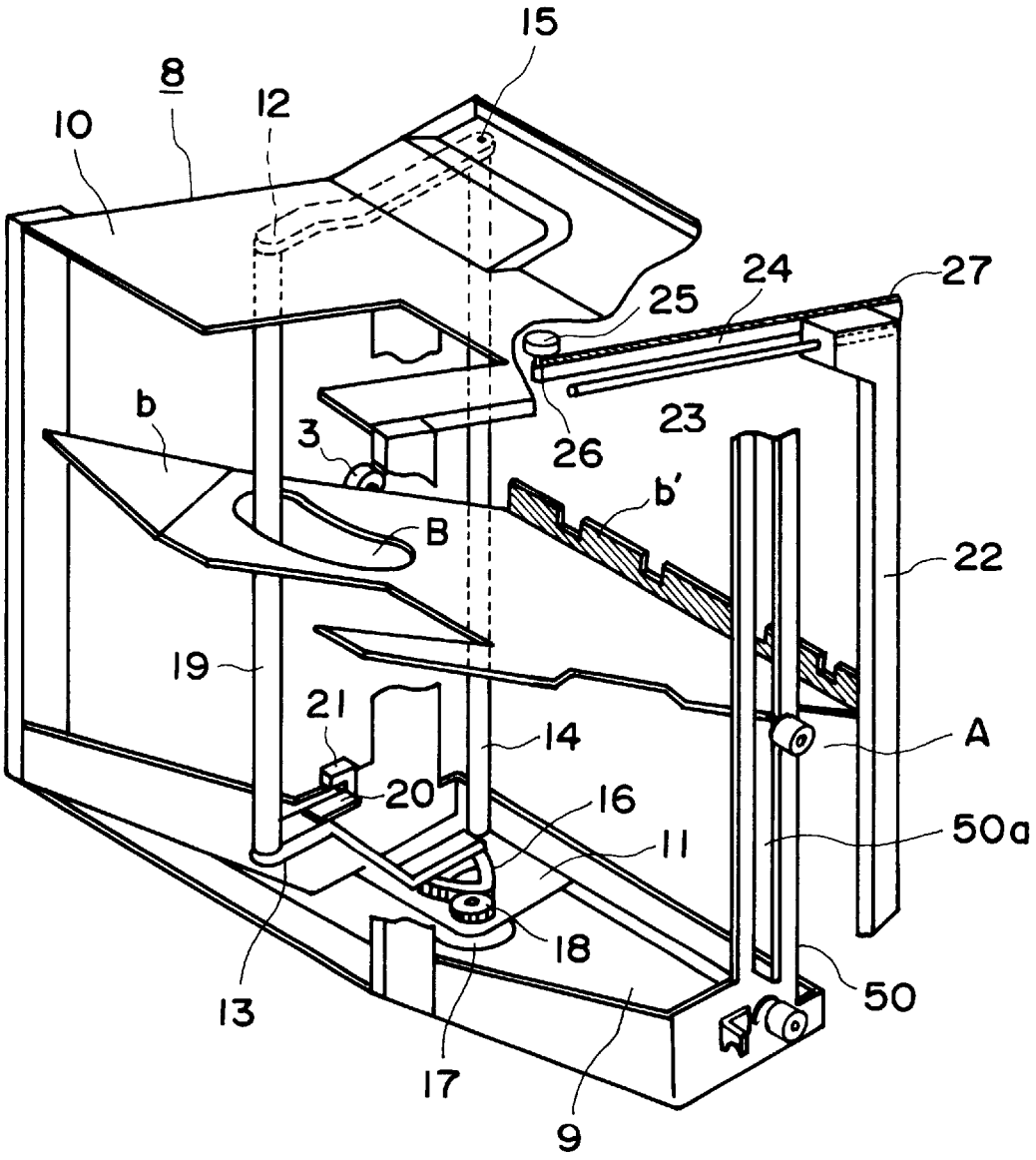
FIG. 4 is a perspective view of a bin unit.

Designated by a reference numeral 7 (broken lines) is an electrically operable stapler for stapling the sheets, and it is disposed at a predetermined position to the bin tray b. As shown in FIG. 3 which is a top plan view of a sorter, the stapler 7 is movable by an unshown driving system between a retracted position 7*a* (solid lines) outside the bin tray region, and an operative position 7*b* (chain lines) in a cut-away portion A formed at a corner of the bin tray b to effect the stapling operation. As shown in FIG. 4, a bin unit 8 for supporting the bin tray b is in the form of a box having guiding plate 50 at each side from the non-sorting tray 10 to a base frame 9. A pin (trunnion) fixed to each side of the bin tray b is inserted into an opening 50*a* of the guiding plate 50. It is inclined downwardly toward the upstream in the sheet discharging direction. To a rear and base side of the base frame 9, a supporting plate 11 is mounted. On the supporting plate 11 a rotational shaft 14 is rotatably supported on an unshown rotational shaft (not shown) on the supporting plate 11 and a rotational shaft 15 on a bottom side of the non-sorting tray 8. The top end of the rotational shaft 14 is fixed to an upper arm 12, and the bottom end thereof is fixed to a bottom arm 13. A sector gear 16 is rotatably mounted on the supporting plate 11 for rotation about a shaft on the supporting plate 11. The sector gear 16 is fixed to the bottom arm 13. Below the supporting plate 11, there is disposed a pulse motor 17, and a gear 17 fixed to the output shaft of the pulse motor 17 is in meshing engagement with the sector gear 16. Between a free end of the bottom arm 13 and the free end of the top arm 12, an aligning rod 18 is extended through cut-away portions B formed in the bin trays b. The aligning rod 19 swings by rotation of the sector gear 16. The bottom arm 13 is provided with a light blocking plate 20. When the light blocking plate 20 swings together with the bottom arm 13, a home position sensor 21 disposed at a rear side of the base frame 9 is rendered on and off.

At a position faced to the aligning rod 19, there is disposed a reference rod 22 penetrating through the cut-away portions A formed in the bin trays b. The reference rod 22 is engaged with a guide rail 23 extending in the sheet discharging direction and supported at a position below the non-sorting tray 10. One end thereof is fixed to a belt 24 extended in parallel with the guide rail 23. The belt 24 is trained around a pulley 26 of the pulse motor 25 disposed below the non-sorting tray 8 and an idler pulley 27. By the forward or backward rotation of the motor 25, as shown in FIG. 3, the aligning rod 22 is movable between a home position P1 where it is outside the bin tray region (behind a stopper b') and an operative position P2 where it is operative for sheet alignment and sheet push-out. The position detection at P1 is effected by a sensor, and the position detection at P2 is effected by the pulse motor 25 being supplied with a predetermined number of pulses. The guide rail 23 is positioned such that the positions P1 and P2 are slightly deviated in the horizontal direction by a small distance K (the position P1 is more front) and such that the movement direction of the reference rod 22 is substantially parallel with the inclined bin tray (FIGS. 2 and 3) to improve the transmission efficiency when the reference rod 22 pushes the sheets on the bin tray b (sheet discharging direction).

The main assembly 200 and the sheet sorter 100 are provided with control circuit CPU, as shown in FIG. 1 to effect control and communication.

Referring to FIGS. 5–9 and 22, the operation will be described.

At step 1, the operator places documents or originals D on an original tray 303 of the automatic document feeder 200 shown in FIG. 1. The number of copies to be taken n, the stapling mode (yes, no) or the like are inputted on an operation panel (not shown) of the image forming apparatus, and the operator actuates the start key.

At step 2, the number of originals N1 is detected by the control circuit of the image forming apparatus 200. For this purpose, the operator may input the number, or the automatic document feeder 200 feeds the originals idle to detect the number of originals.

At step 3, the control circuit discriminates the number N2 of the sets of sheets received by one bin on the basis of the set number n. The number of bin trays is 20 in this embodiment. Therefore, N2=1 when n=0–20, N2=2 when n=21–40, and N2=3 when n=41–60.

The maximum accommodatable number N3 of one bin tray has been empirically determined and stored in the control circuits. The discrimination is made as to whether or not N1×N2<N3.

The operation at step 4 will be described. If the result of discrimination at step 3 with negative, it means that the number of sheets to be received by one bin tray will exceed the accommodatable limit, and therefore, warning (sound or display) is effected to the operator.

Figure 5:
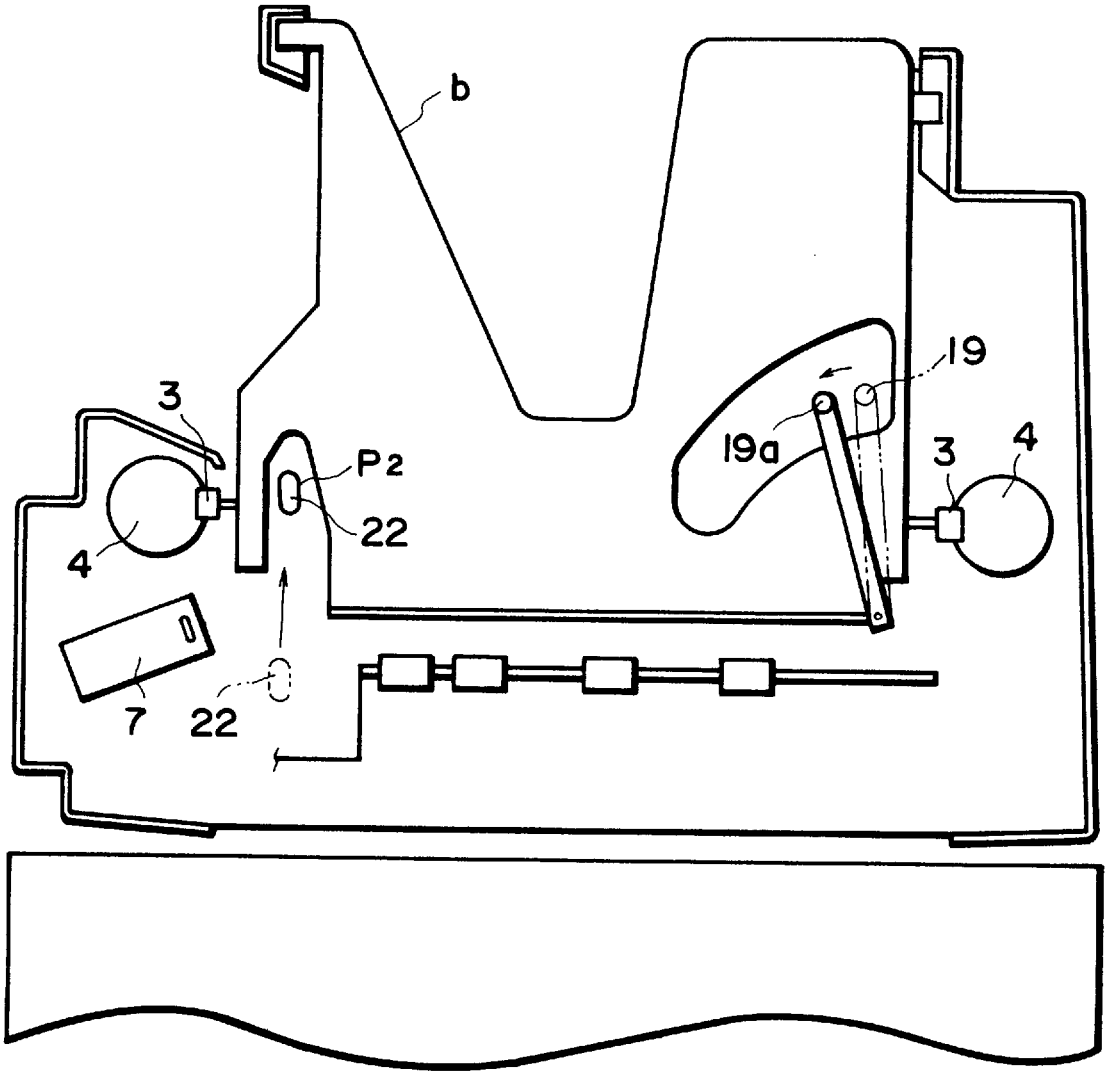
FIG. 5 is a flow chart of sequential operations.

The operation at step 5 will be described. If the result of discrimination at step 3 is affirmative, the aligning rod 22 at the home position is moved to the position P2 which is the reference position for the alignment, as shown in FIG. 5. The aligning rod 15 is moved from its home position to a stand-by position 19*a* corresponding to the size of the sheets to be discharged.

Figure 6:
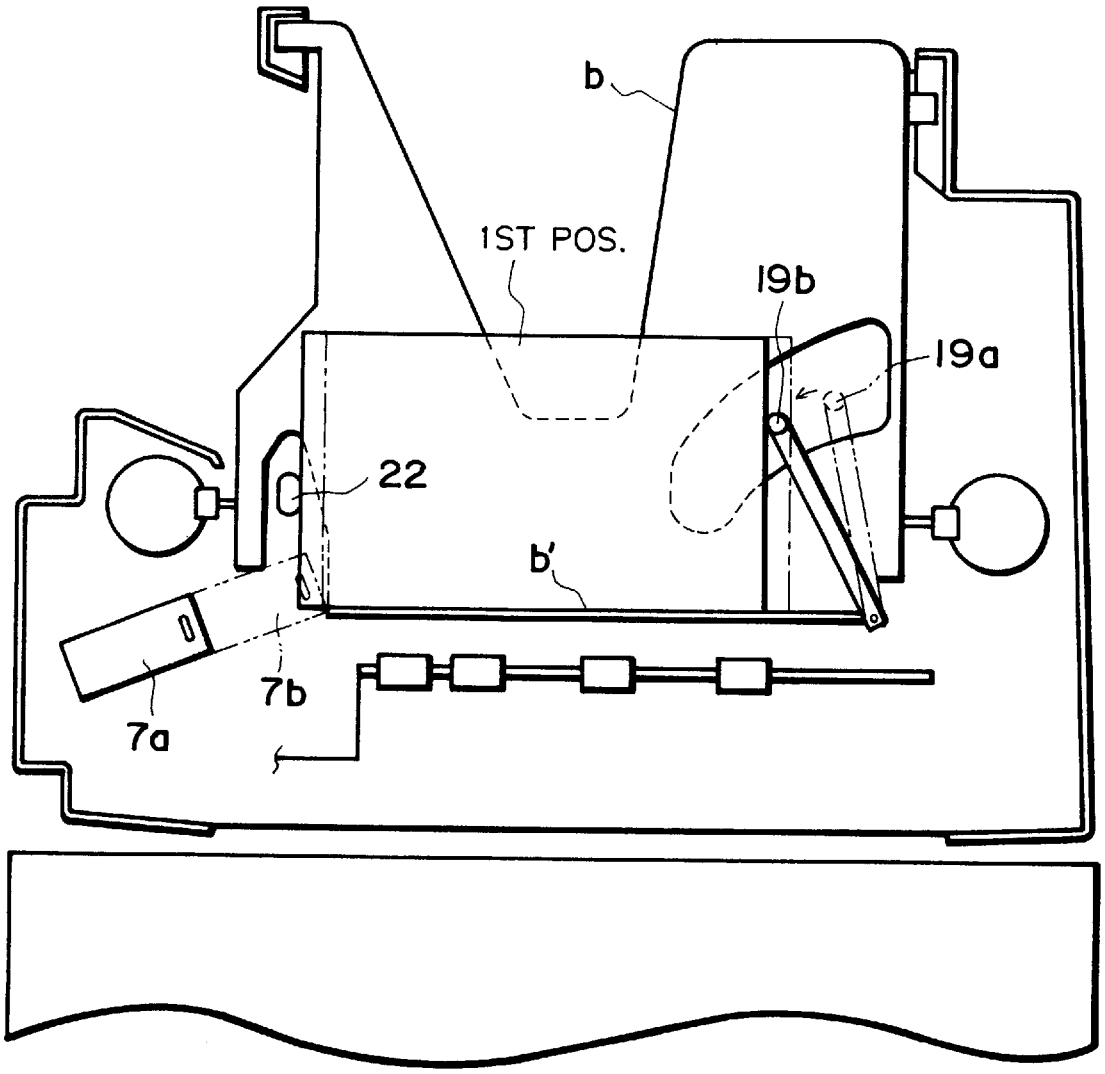
FIG. 6 is a flow chart of sequential operations.

After the above preparatory operations are completed, the operations at steps 6 and 7 are executed. The sheets discharged from the main assembly 200 of the image forming apparatus are sorted. When the set number n is larger than the number of bin trays 20, the first 20 sets are sorted, and if it is smaller than 20, the n sets are sorted. The automatic document feeder 300 separates the bottom sheet and feed it onto the platen glass 208 of the image forming apparatus 200 through a path 301, wherein the bottom is the last page of the originals. When the original is stopped on the platen glass 208, the unshown optical system is operated to start the image forming operation. The sheet having the developed image transferred thereto is discharged to a first bin tray b1 (placed at the position corresponding to the discharging rollers) through the sorting path 6*a* (FIG. 6). The sheet discharged to the bin tray b1 is moved by the weight thereof to a stopper b' on the bin tray which is inclined so that the stopper b' is at a lower level (chain lines).

The aligning rod 19 at the position 19*a* starts to move through a predetermined distance in the direction indicated by an arrow by the pulse motor 17 which is operated on the basis of the pulses, the number of which corresponds to the sheet size. After it is abutted to a side of the sheet, it is moved to a first sheet position (19*b*) to abut the opposite end to the reference rod 22 (FIG. 6). Subsequently, the aligning rod 19 is returned to the stand-by position 19*a* to be prepared for the next sheet discharging.

In this manner, one sheet is stacked on the bin tray. Subsequently, the next bin tray is aligned with the pair of discharging rollers by rotating the helical cam 4, and the transfer sheet having the image corresponding to the last page of the originals is received by each of the necessary bin trays with the lateral edge abutted to the reference rod 22 and with the trailing edge abutted to the stopper b'.

When the image transfers for the last page of the originals are all completed, the original on the platen glass 208 is fed through the path 203 and is discharged to the topmost surface of the set of originals D on the original tray 303. Between the copied original and the uncopied originals, a partition lever is placed (not shown) to provide discrimination therebetween.

The above operations are repeated for the number of originals, by which the desired number of copies are stacked and aligned. At this time, one circulation of the set of originals are completed by the automatic document feeder 300, and now the first page is at the top.

Step 8 will be described. If the stapling mode is selected at step 1, the operation proceeds to step 9, whereas the non-stapling mode is selected, the operation proceeds to step 11.

At steps 9 and 10, as shown in FIG. 6, the stapler 7 at the home position 7*a* receives operation start signal from the control circuit CPU and is moved to its operative position 7*b* (broken lines). Then, it staples at a rear corner of the sheets. At this time, the sheets are confined by the reference rod 22 and the aligning rod 19 at the lateral edges thereof, so that the sheets are not deviated when they are being stapled. After the stapling, the stapler 7 returns to the home position 7*a*. The helical cam 4 is rotated by one full turn to shift the bin tray by one stage for stapling the sheets on the next tray.

By repeating the above-operations, all the sheets are stapled respectively.

Figure 7:
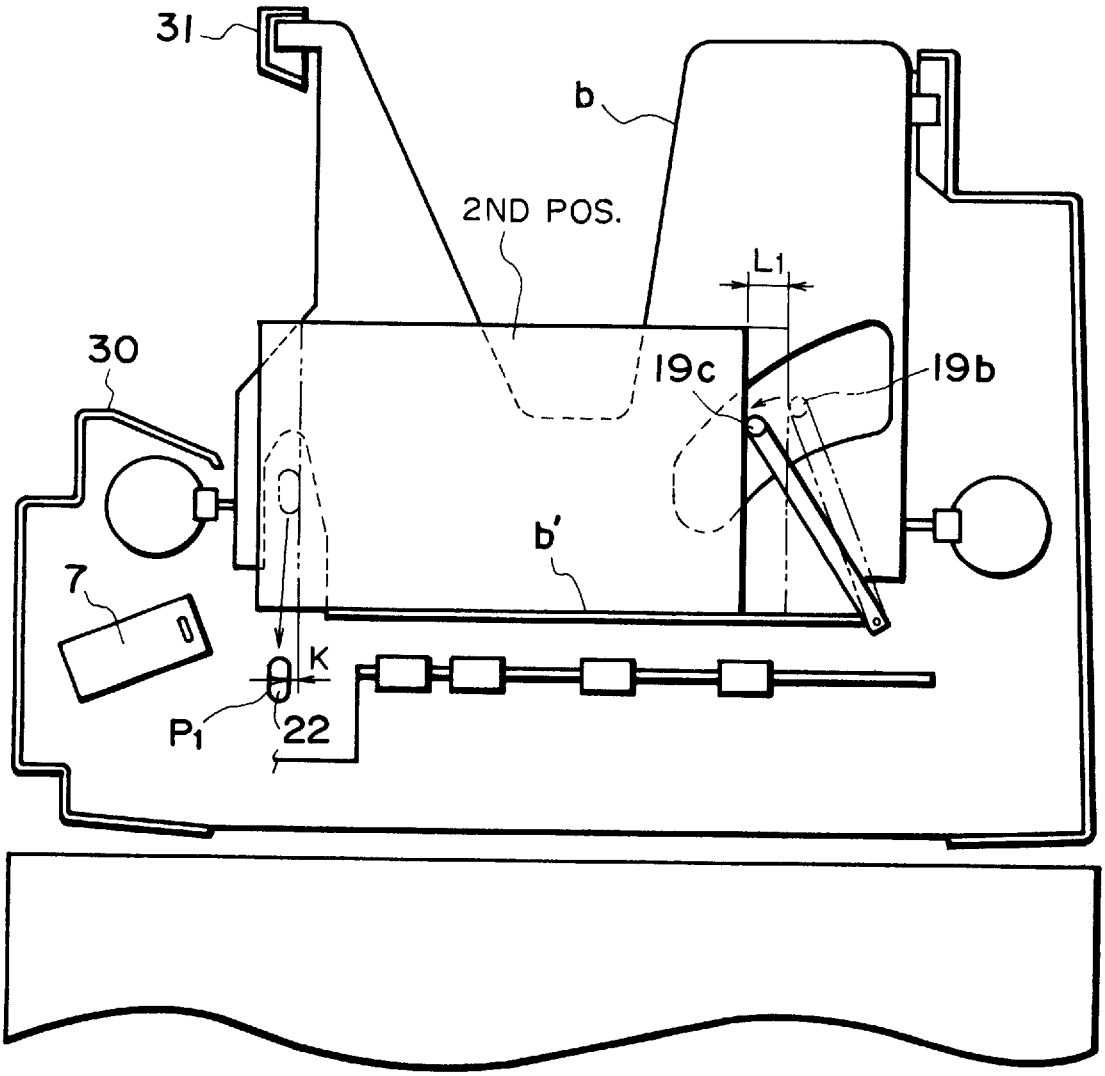
FIG. 7 is a flow chart of sequential operations.

At step 11, as shown in FIG. 7, the aligning rod 22 abutted to the lateral edge of the sheet at the aligning reference position P2 is moved to the home position P1 by the pulse motor 25. The moving path of the aligning rod 22 is such that it is away from the lateral edge of the sheet set, as described hereinbefore, by the provision of the step K, the sheets are not deviated during this motion.

At step 12, the aligning rod 19 is moved by the pulse motor 17 from the alignment position 19*b* by a predetermined distance L1 (L1>K) (19*c*). By the movement of the aligning rod 19, the lateral edge of the sheet is pressed, and the sheet set is pushed out toward the front side of the apparatus along the stopper b' to a second sheet position shown in FIG. 7.

Figure 8:
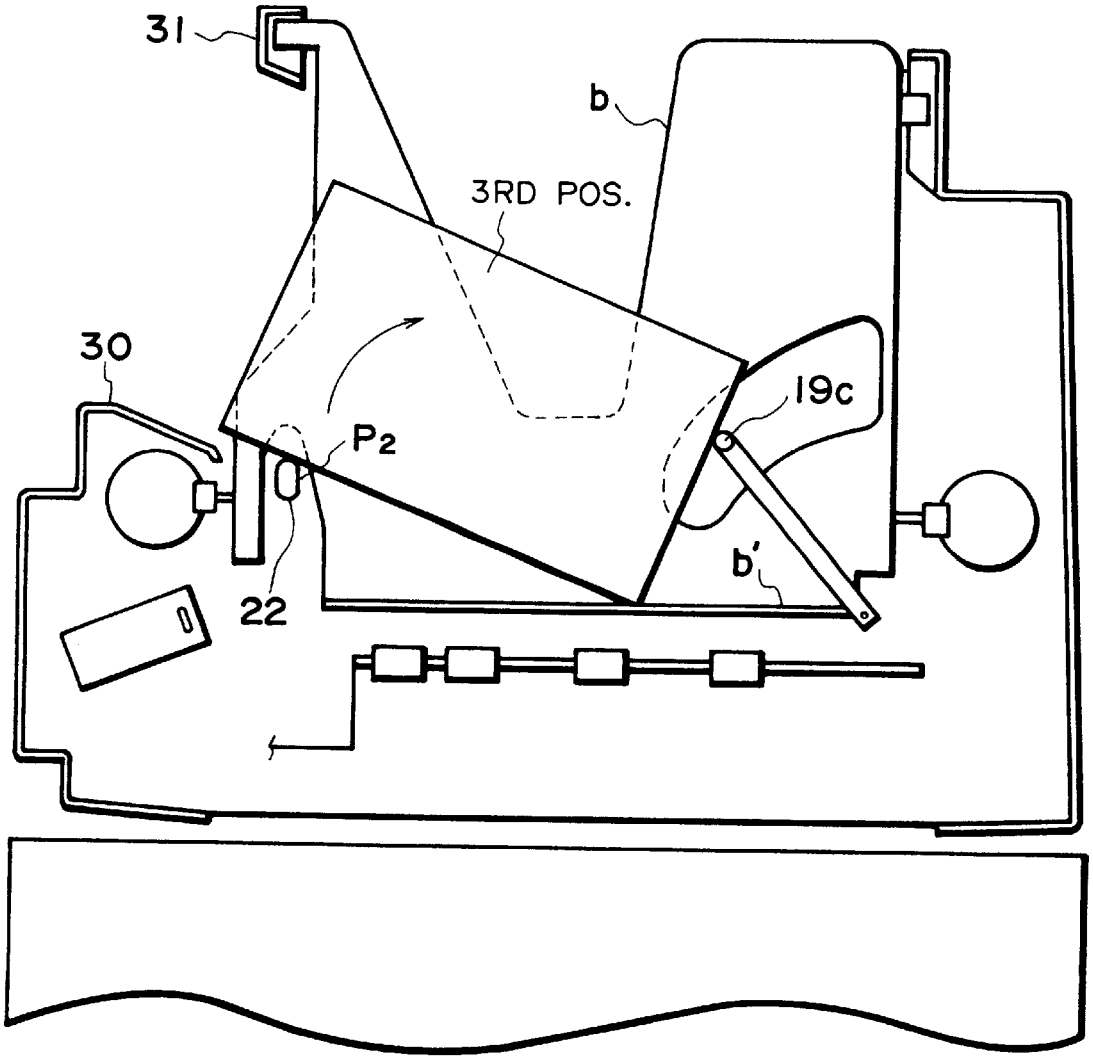
FIG. 8 is a flow chart of sequential operations.

At step 13, the aligning rod 22 at the retracted position P1 at step 11, is returned to the position P2 with the sheet trailing edge raised. The trailing edges of the sheets are confined by the reference rod 22 and the stopper b', and the lateral edge thereof is confined by the aligning rod 19, and the sheets are positioned in an inclined direction on the bin tray as shown in FIG. 8 (a third sheet position).

Figure 9:
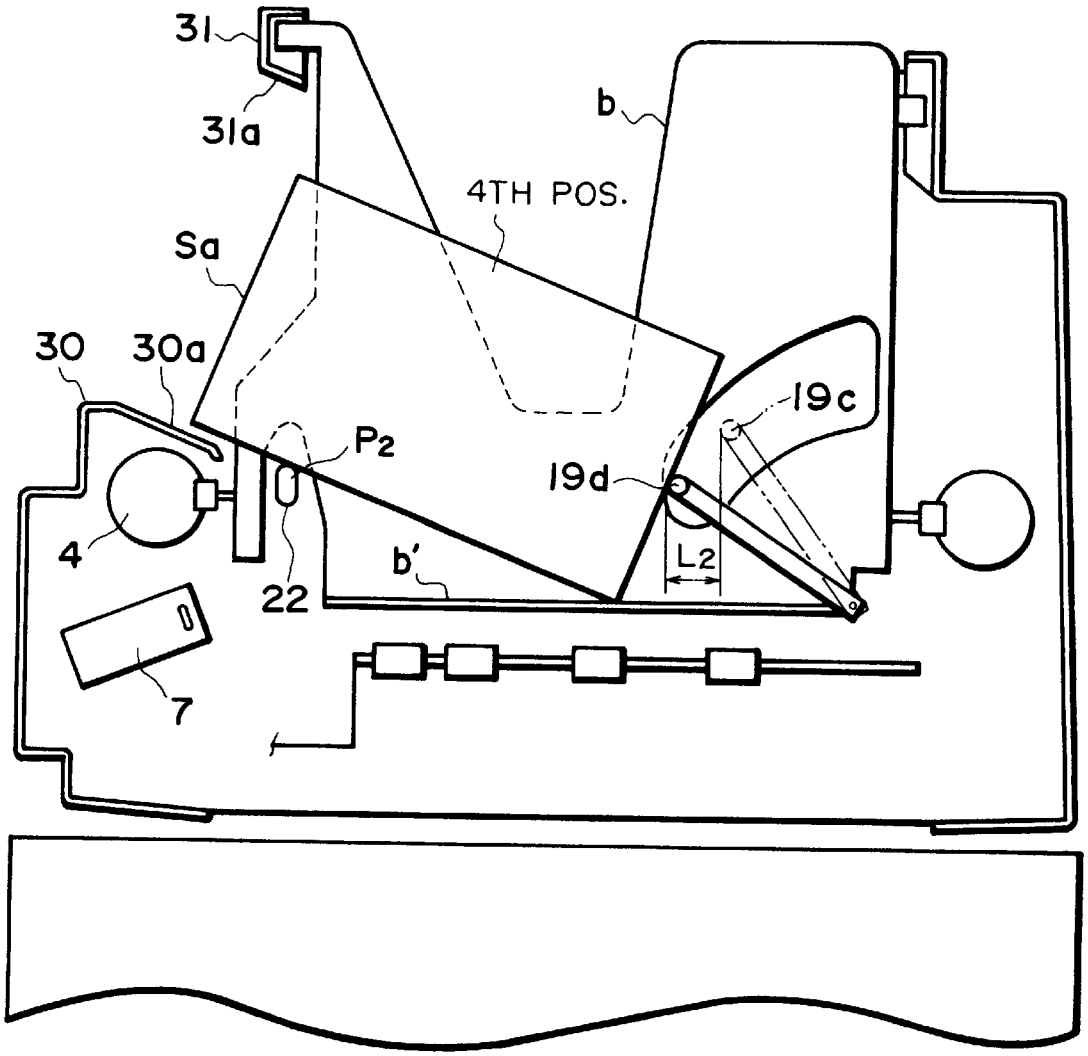
FIG. 9 is a flow chart of sequential operations.

At step 14, as shown in FIG. 9, the aligning rod 15 is moved through a predetermined distance L2 in the direction indicated by an arrow (19*d*). Between the front covers 30 and 31*a* and the inclined surfaces 30*a* and 31*a* of the sorter 100, there is provided a space sufficient to permit passage of the sheets. This passage permits the sheet to be taken out from a front side of the sorter, that is, from the left as viewed in FIGS. 7–9. The motion of the aligning rod 19 through the distance L2 is effective to completely push the end portion Sa of the sheets to outside of the apparatus (a fourth sheet position). The aligning rod 19 and the reference rod 22 penetrate through all of the bin trays, and therefore, through the above-described operations, the sheet sets on all of the bin trays are pushed toward the front, circumventing the helical cam 4, the stapler 7 the cover and the like.

At step 15, the operation of the apparatus is completed if the set number n of the sheets are all sorted. On the other hand, there remains a rest number to be sorted, the operations of steps 5 through 14 are repeated.

The description will be made as to the case in which a plurality of sets of sheets are stacked on each of bin trays.

Figure 10:
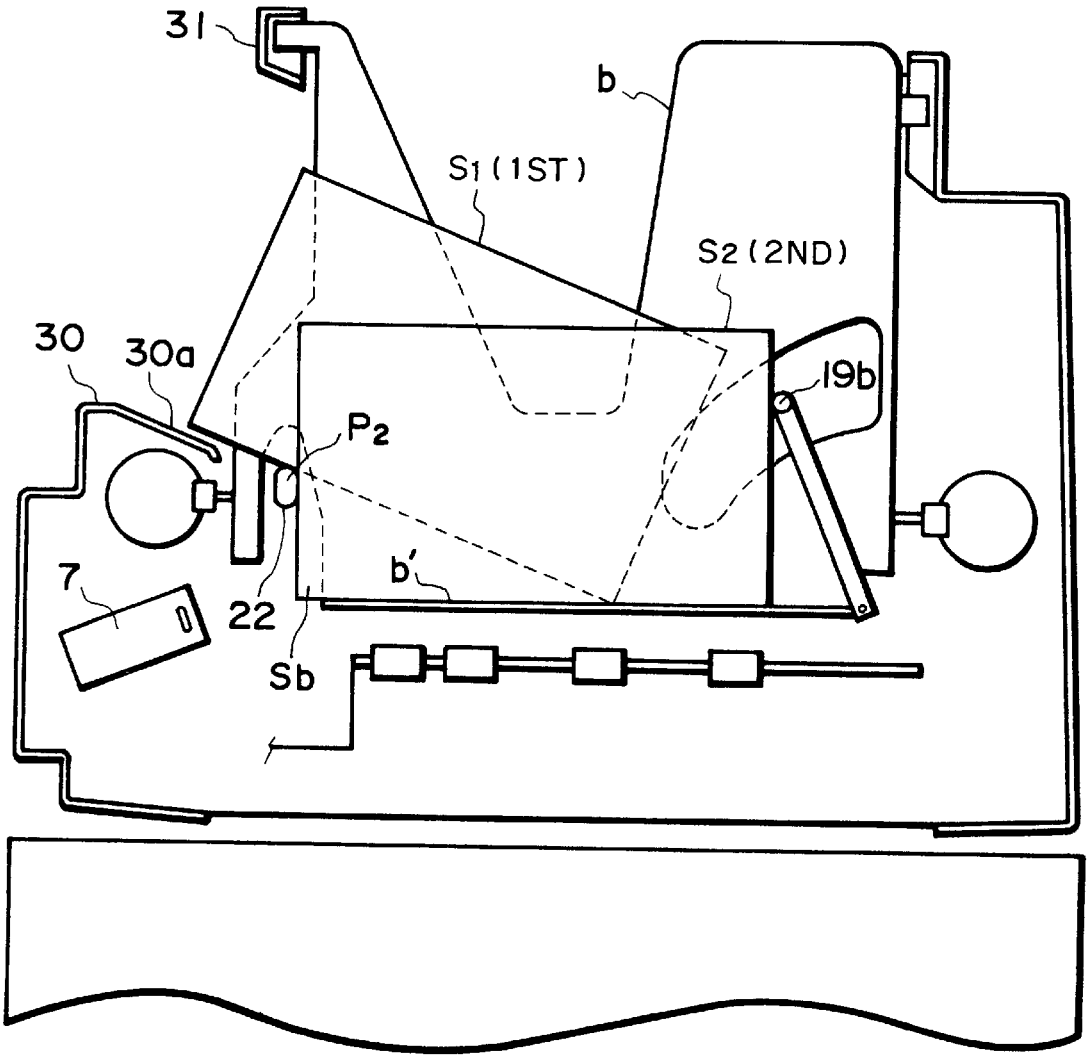
FIG. 10 is a flow chart of sequential operations for a second sheet set.

As shown in FIG. 10, through the similar operations, the second set sheets are aligned and stacked on the first set in the bin which is at the fourth sheet position inclined on the bin tray, as described hereinbefore. When the stapling mode has been selected, the stapler 7 staples a position where the fourth sheet position (first set) and the first sheet position (second set) are not overlaid (Sb), and therefore, only the sheets at the first sheet position (second set) are stapled.

Figure 11:
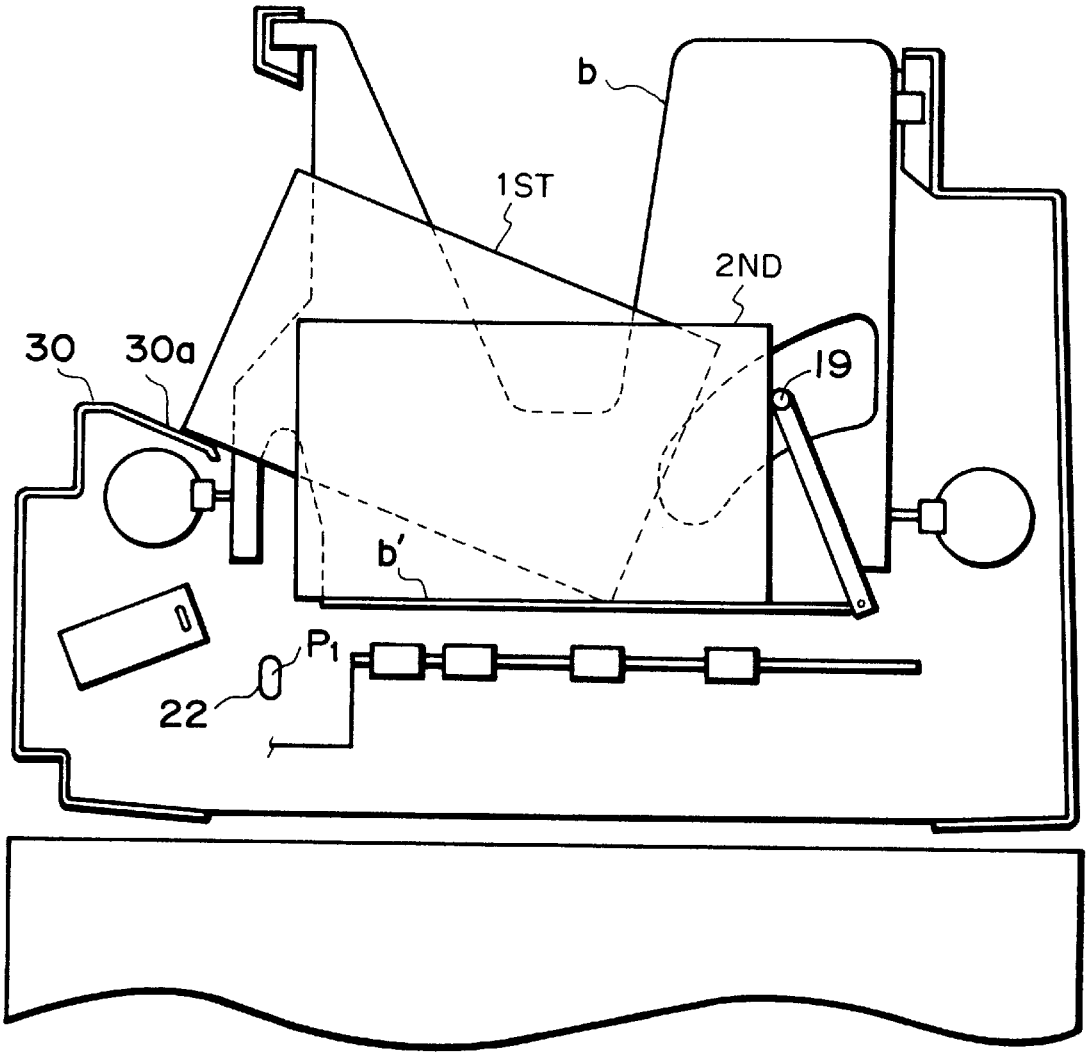
FIG. 11 is a flow chart of sequential operations for a second set of sheets.

Similarly to step 11, the aligning rod 22 moves to the home position P1. A rear corner of the first sheet set in the bin is confined by an end portion 30*a* of the cover 30, and therefore, the inclined position is not disturbed (FIG. 11).

Subsequently, by the operations of steps 12–14, the second sheet in the bin is pushed to the fourth position. The operations are the same for the third and subsequent sets, so that a plurality of sheet sets are overlaid on each bin tray, and are grouped by the staples.

Figure 12:
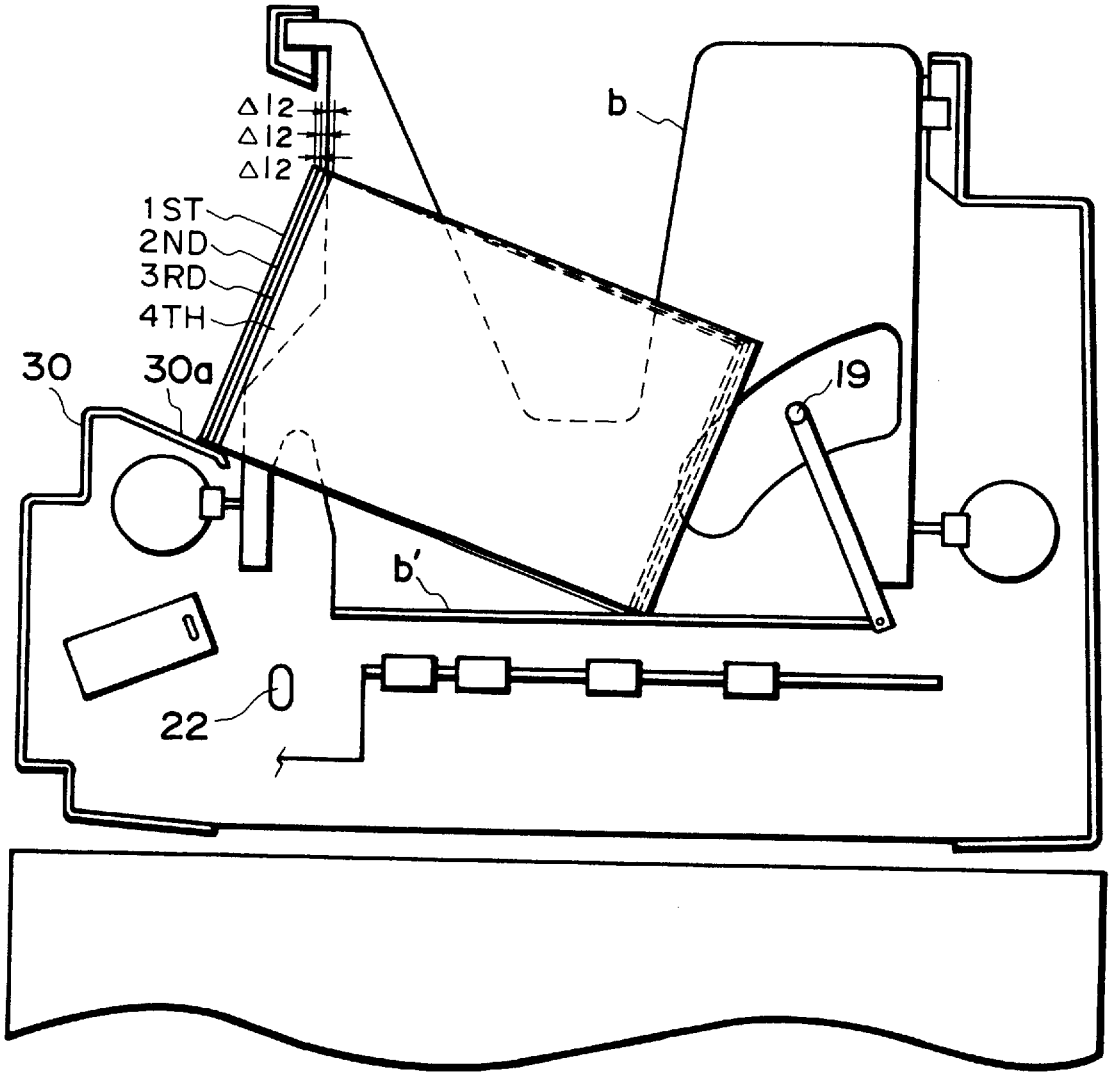
FIG. 12 illustrates grouping of sheet sets in non-stapling mode operation.

If the non-sorting mode has been selected, the pushing distance of the aligning rod 19 toward the fourth sheet position is L2, but it is (L2−δ12), and it is (L2−2×δ12) for the third set, at step 14. By doing so, the plurality of sets on each bin tray is spatially grouped by offset of δ12 (FIG. 12).

The spatial grouping using the offset δ12, may be used in the stapling mode.

If the apparatus of this embodiment is used to provide the spatial discriminations between sheet sets on the one bin tray, the sheets at the fourth sheet position, is not necessarily required to project a part of the set to the outside of the apparatus. For example, they may be differentiated by inclination and non-inclination of the sheet sets.

Embodiment 2

Figure 13:
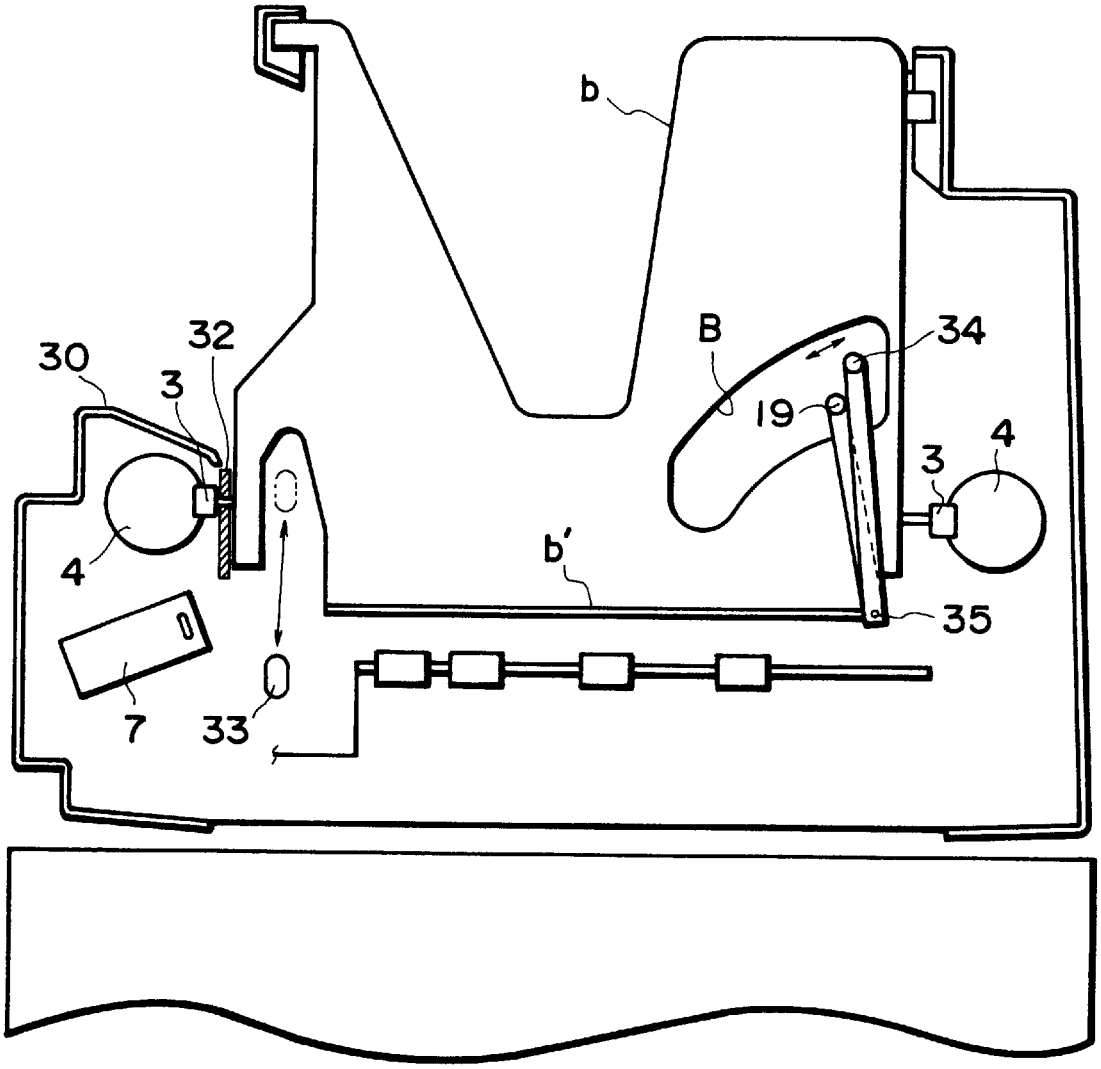
FIG. 13 is a top plan view of an apparatus according to another embodiment of the present invention.

The aligning rod 19 in the foregoing embodiment functions as moving means (first sheet moving means) for moving the sheets from the first sheet position to the second sheet position or from the third sheet position to the fourth sheet position, after completion of the sorting operation. In addition, the reference member 22 functioning as positioning the lateral edge of the sheet during sheet aligning operation, and also functions as sheet moving means (second sheet moving means) for moving the sheets from the second sheet position to the third sheet position after completion of the sorting operation. However, as shown in FIG. 13, they may be independent means. The other members are the same as in the first embodiment, and therefore, the same reference numerals in the first embodiment are assigned to the corresponding elements. Referring to FIG. 13, the second embodiment will be described in detail.

The first sheet moving means 34 is formed into a rod at its end, and penetrates through the opening B formed in each of the trays, together with the aligning rod 19. It is swingable in a direction indicated by an arrow about a shaft 35 by the driving motor (pulse motor or the like). The aligning rod 19 and the first sheet moving means 34 are spatially separated, and are operated by separate driving sources, and there is no liability of interference.

Figure 14:
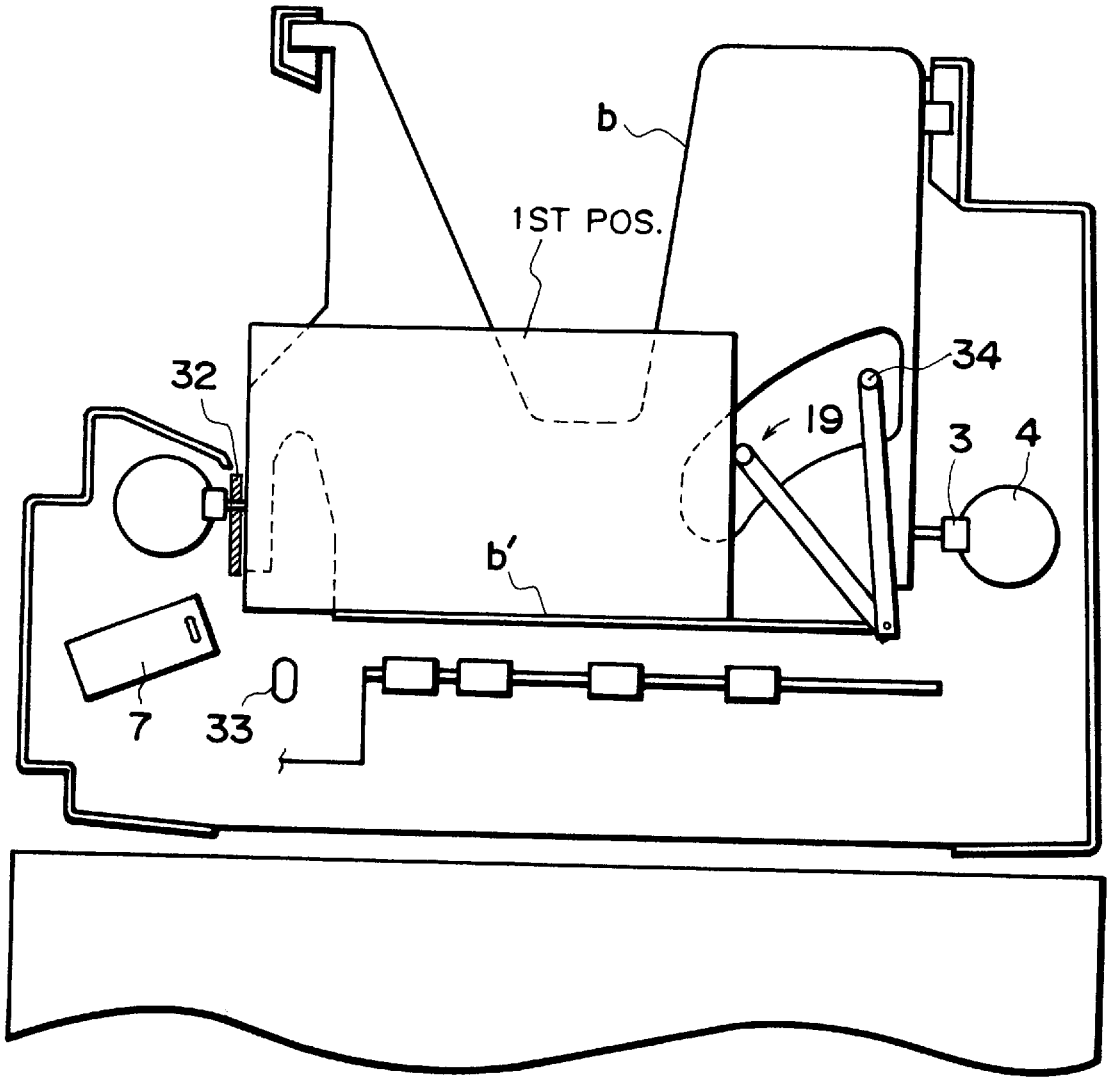
FIG. 14 is a flow chart of sequential operations in the apparatus.
Figure 15:
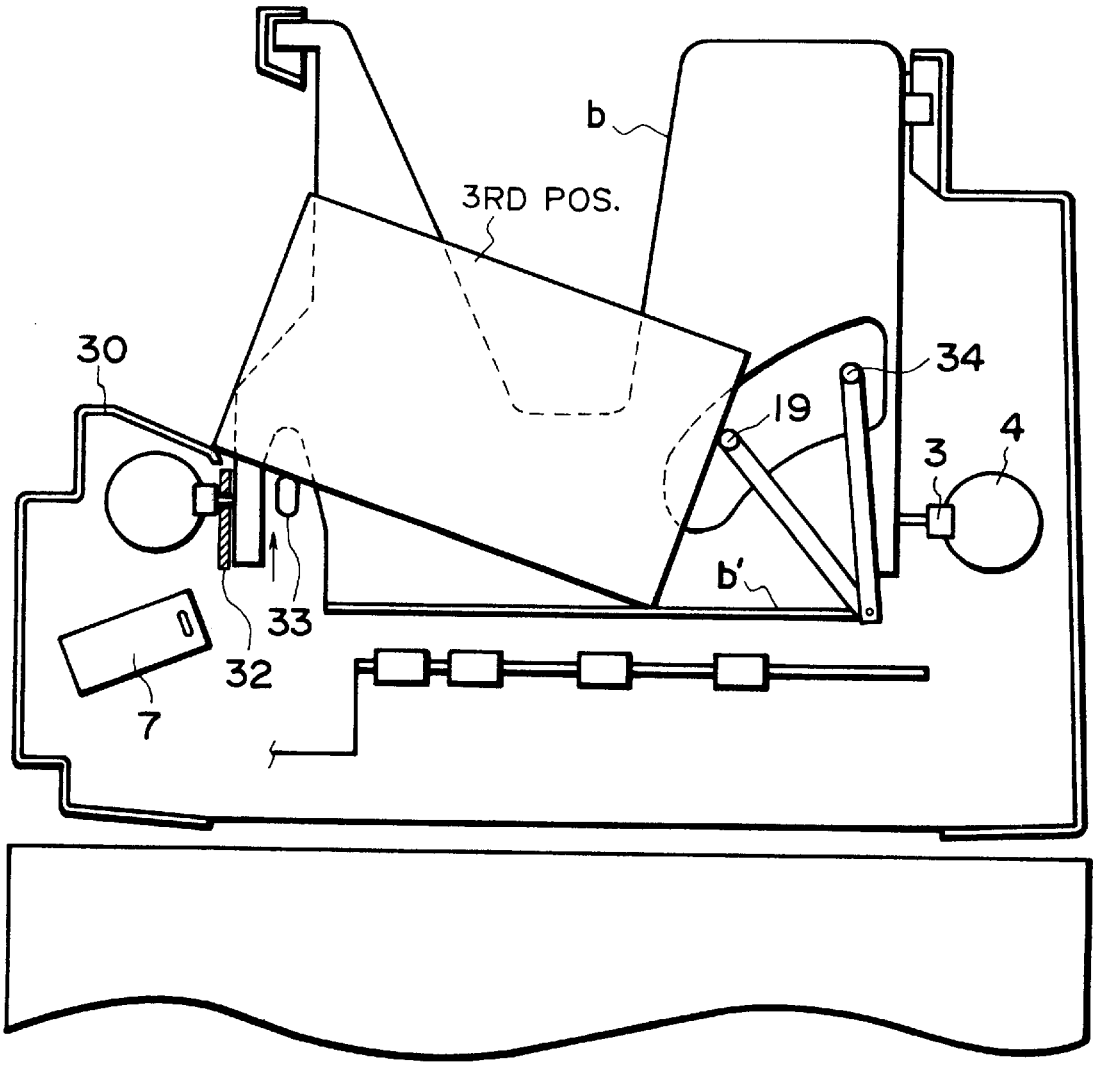
FIG. 15 is a flow chart of sequential operations of the same.
Figure 16:
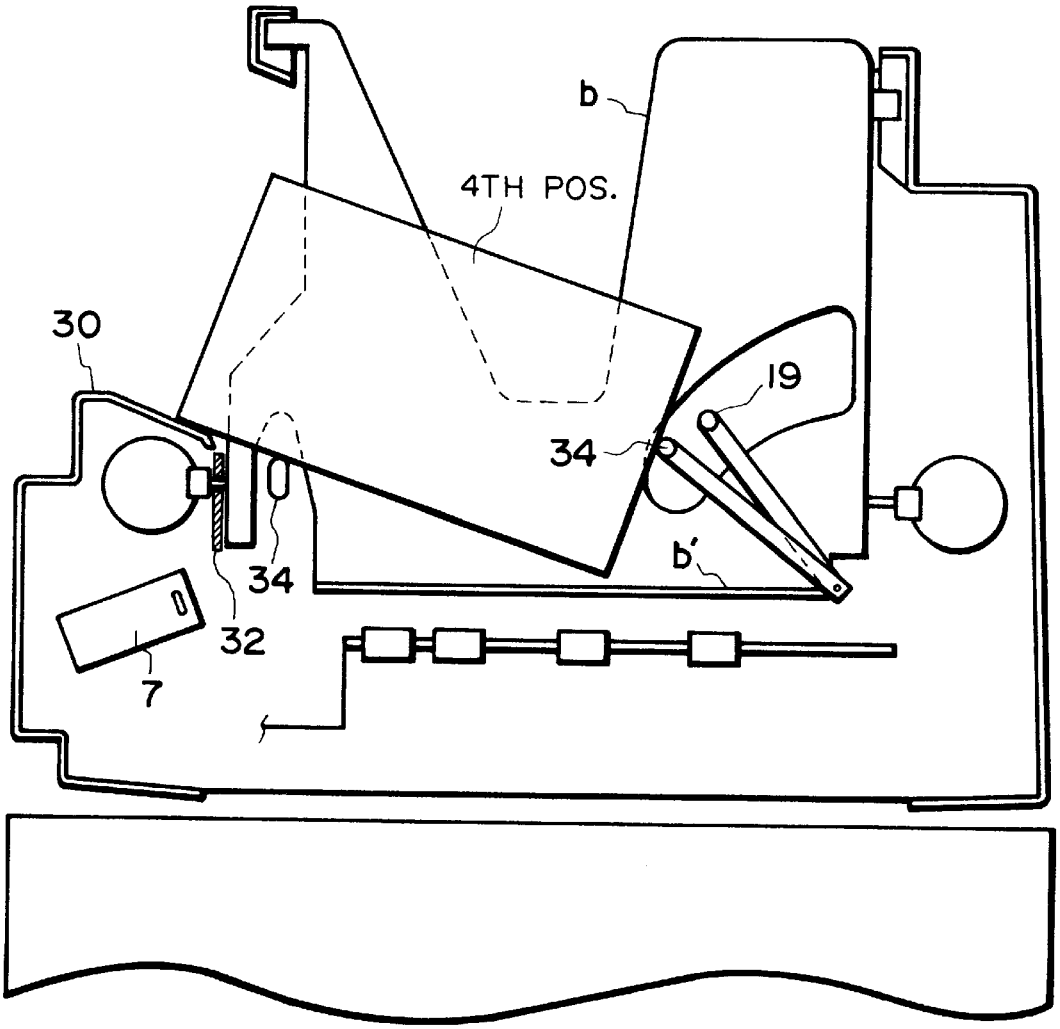
FIG. 16 is a flow chart of sequential operations of the same.

The second sheet moving means 33 has the same structure as the reference rod 22 in Embodiment 1, and is reciprocable in a direction parallel with the sheet discharging direction (between the solid line position and the chain line position). A reference plate 32 is fixed at a front side of the second sheet moving means 33 to the inside of the cover 30 so as to be faced to the aligning rod 19. The operation of the apparatus of this embodiment is substantially the same as that of Embodiment 1. However, at step 9, upon start of the sorting operation, the sheet discharged to the bin tray b is pushed by the aligning rod 19 so that an end of the sheet is abutted to the reference plate 32, as shown in FIG. 14 (a first sheet position). At this time, the first sheet moving means 34 and the second sheet moving means 33 has been moved to a retracted position to avoid interference with the above operation. The operations in steps 11 and 12 are omitted. At step 13, the sheets at the first sheet position are moved to a third sheet position by the second sheet moving means 34 (FIG. 15). Subsequently, they are moved to the fourth sheet position by the first sheet moving means 34 (FIG. 16). The operation for accommodating two or more sheet sets on one bin tray with spatial grouping thereof, is the same.

As compared with the first embodiment, the second embodiment requires shorter processing time (the time required for the steps 11 and 12). In addition, the sheet contacting surface of the reference plate 32 is larger than that of the reference rod 22 in the foregoing embodiment (the comparison on the basis of the same space). This is effective to improve the aligning performance. By the provision of driving sources for the aligning rod 19 and the first sheet moving means 34 as in Embodiment 2, the aligning operation (high speed and low load) and the sheet pushing operation (low speed and high load), can be performed both (independent operations are possible).

The same advantageous effects may be provided in a sorter using the aligning rod 19 having the function of aligning and pushing operation in Embodiment 1 and having a reference plate 32 and the second sheet moving means 33 in the second embodiment. The same applies to a sorter having the reference rod 22 having the aligning and pushing function in Embodiment 1 and having the aligning rod 19 and the first sheet moving means in Embodiment 2.

Figure 17:
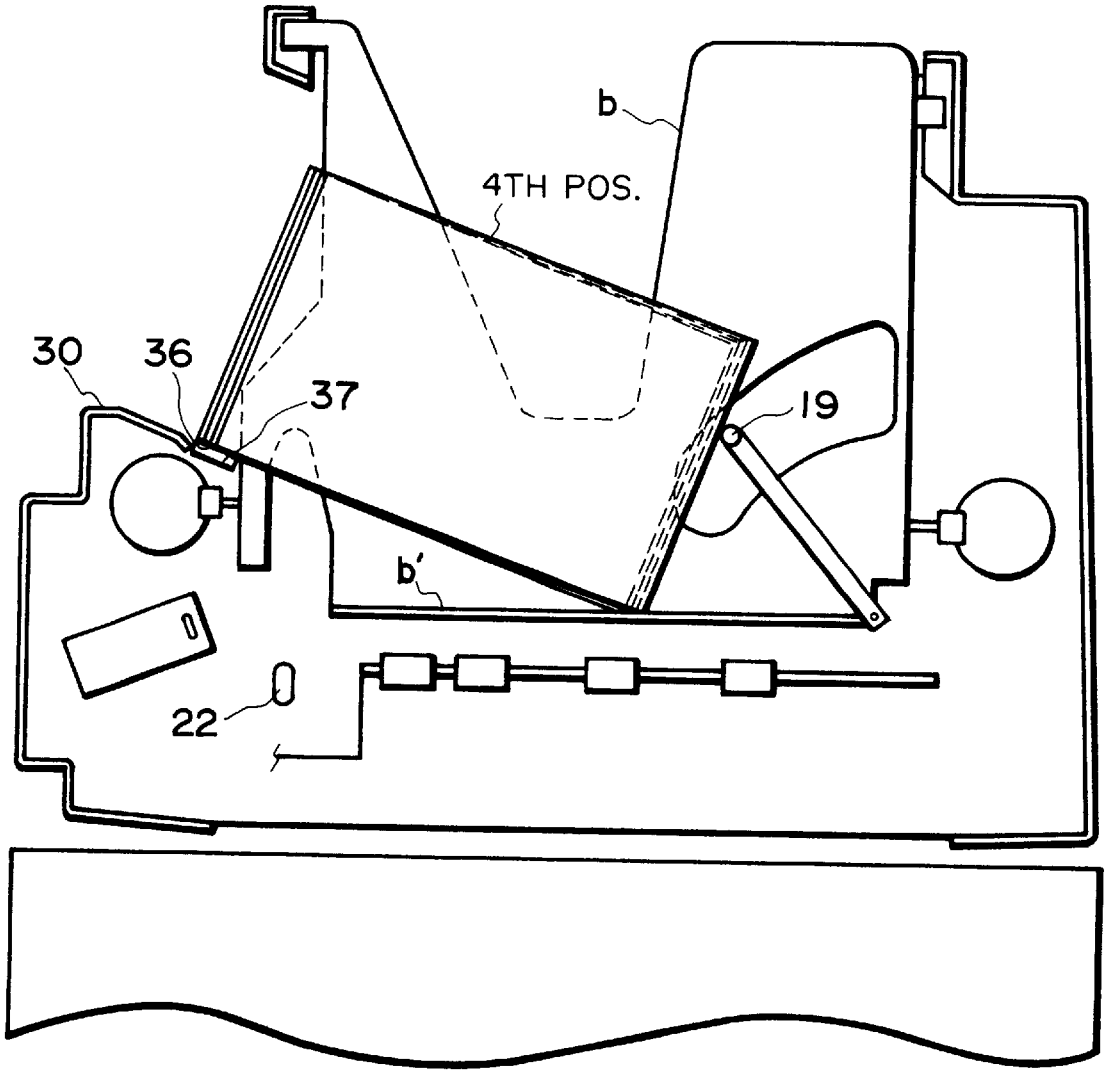
FIG. 17 is a top plan view of an apparatus according to a further embodiment of the present invention.

In the foregoing embodiments, an end 30*a* of the cover 30 is used as means for confining at the fourth sheet position when a plurality of sheets are accommodated on one bin tray (FIG. 12), but as shown in FIG. 17, a confining member 37 having a high friction material 36 (rubber for example) bonded to the sheet contacting surface, may be usable. As compared with the foregoing, the sheet sets in the fourth sheet position are more securedly held.

Figure 18:
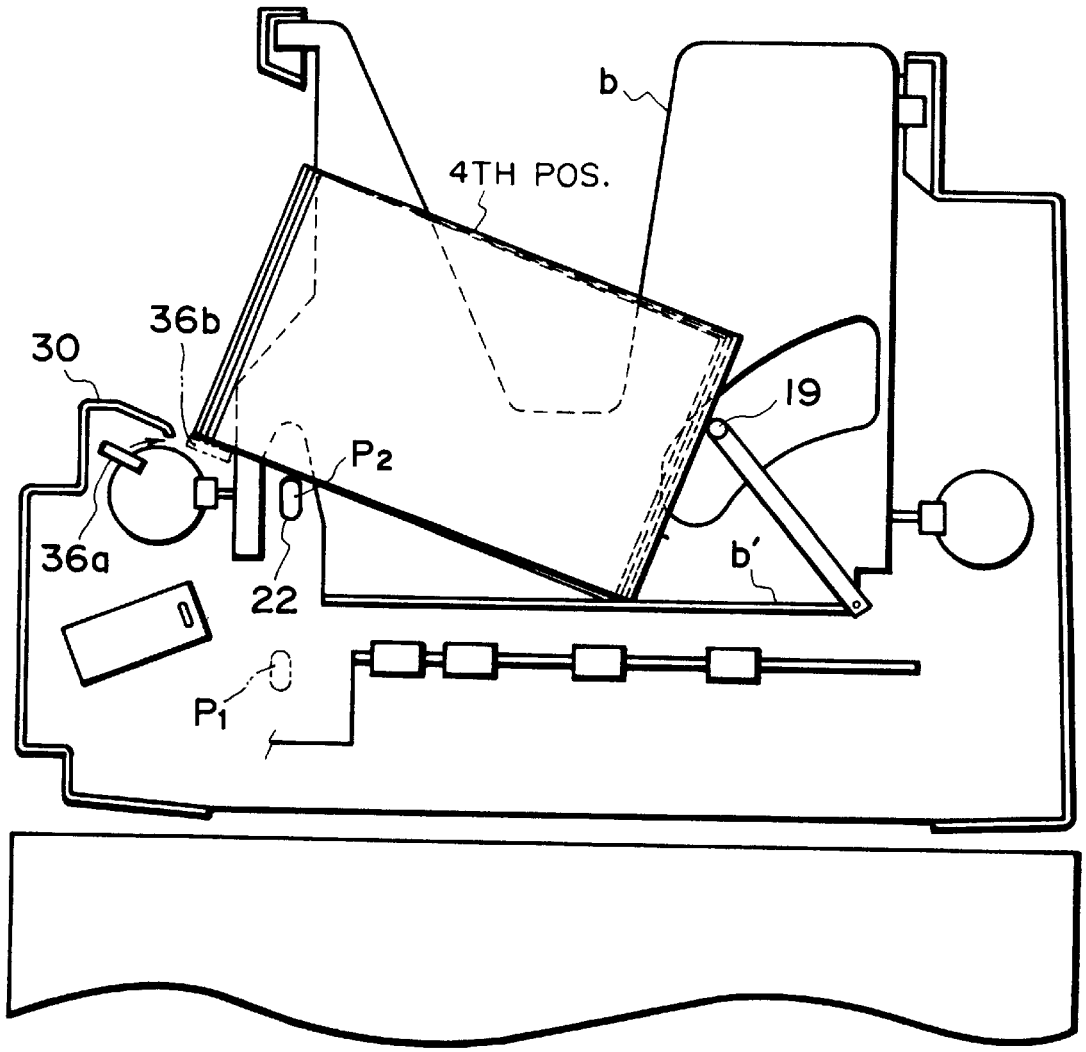
FIG. 18 is a top plan view of an apparatus according to a yet further embodiment of the present invention.

The confining member 36 may be retractable relative to the sheet set at the fourth position (FIG. 18). In this case, when the sheets at the fourth sheet position are supported at position P2 of the reference rod 22, the confining member 36 has been moved to a position 36(*a*) away from the sheet, and therefore, there is no interference between the aligning rod 19 and the sheet pushing operation. When the reference member 22 is retracted to the position P1, the confining member 36 is moved and controlled to a position 36(*b*) for holding the sheet. There are provided a plunger for driving it and guiding members for guiding the movement thereof.

The first aligning rod 19 and the first sheet moving means 34 of the Embodiments 1 and 2 are moved about a shaft along an arcuated path, but they may be linearly moved by driving means including a rack and pinion gear.

When the number of sheets sets to be accommodated on one bin tray is limited to 2, the first set may be placed at the third or fourth sheet position (inclined), and the second set is placed at the aligned position (the first sheet position) (step 9). By doing so, the clear spatial grouping is accomplished. Since the pushing action from the third position to the fourth position in the foregoing embodiment (step 14), is to improve the sheet taking-out operativity at the front side, and therefore, may be omitted if the sheet sets can be taken out easily at the third sheet position.

Figure 19:
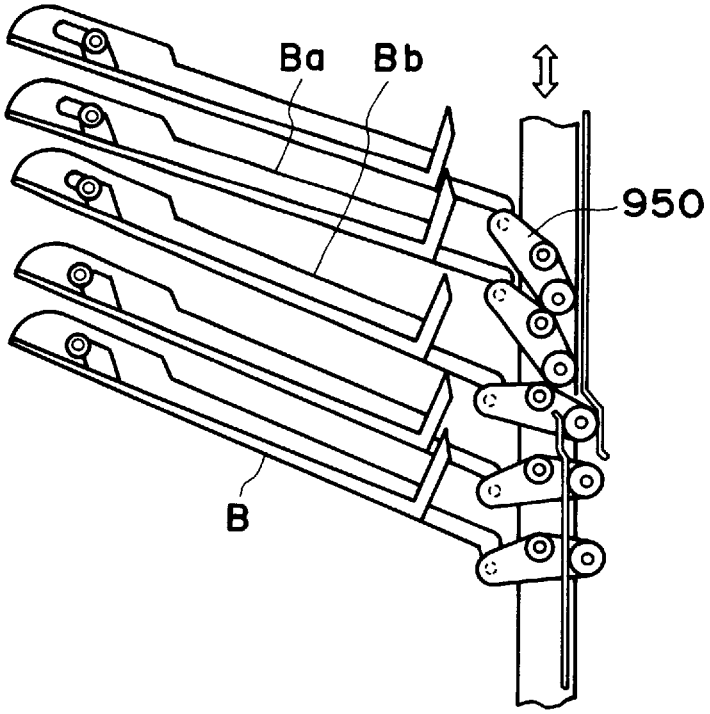
FIG. 19 is a front view of a sorter according to a further embodiment of the present invention.
Figure 20:
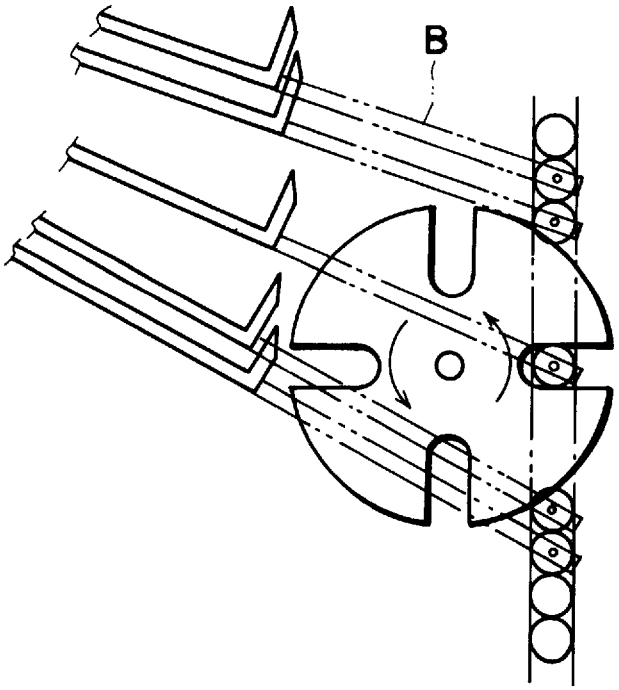
FIG. 20 is a front view of a sorter according to a further embodiment of the present invention.
Figure 21:
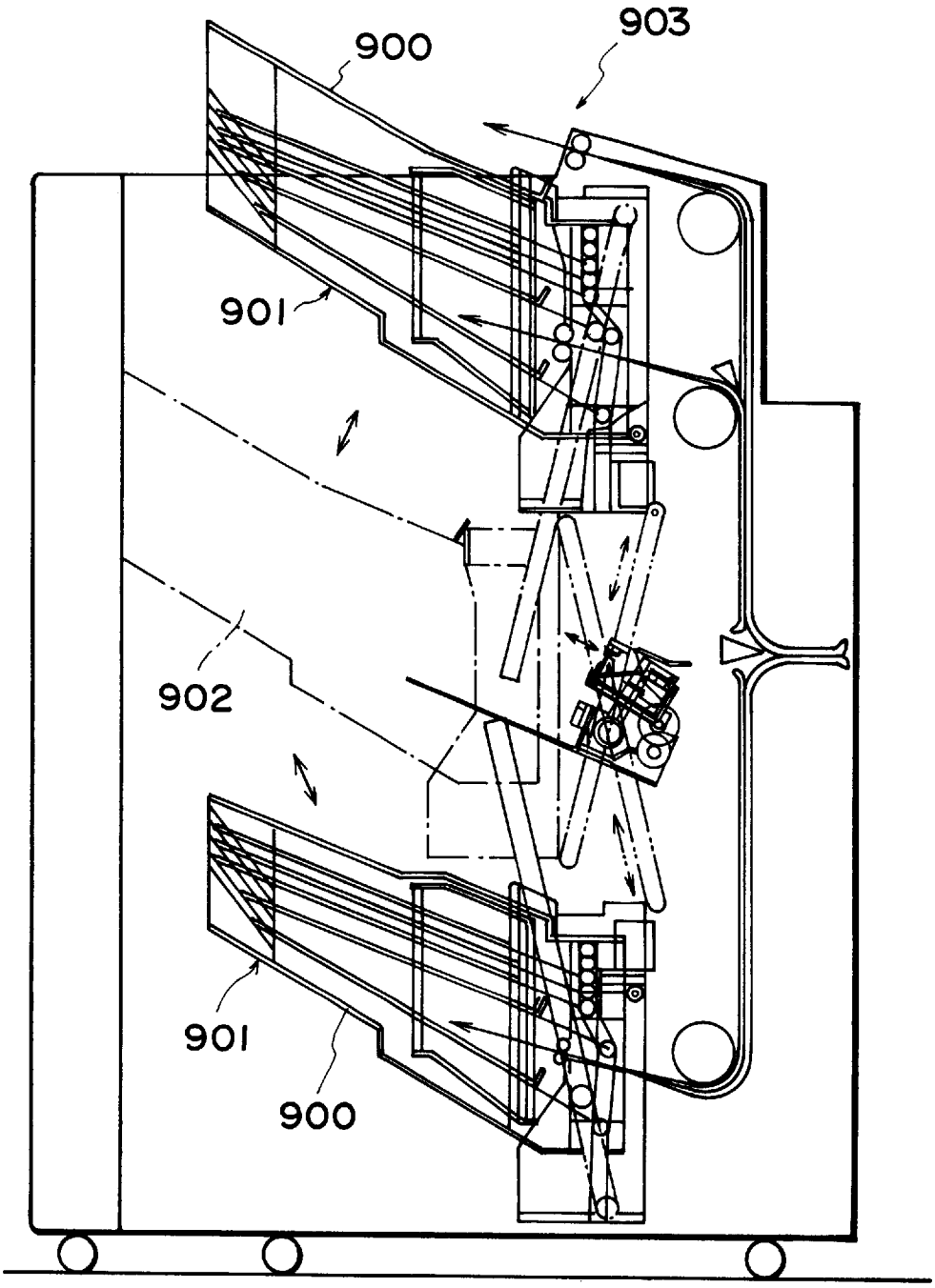
FIG. 21 is a front view of a sorter according to a yet further embodiment of the present invention.
Figure 22:
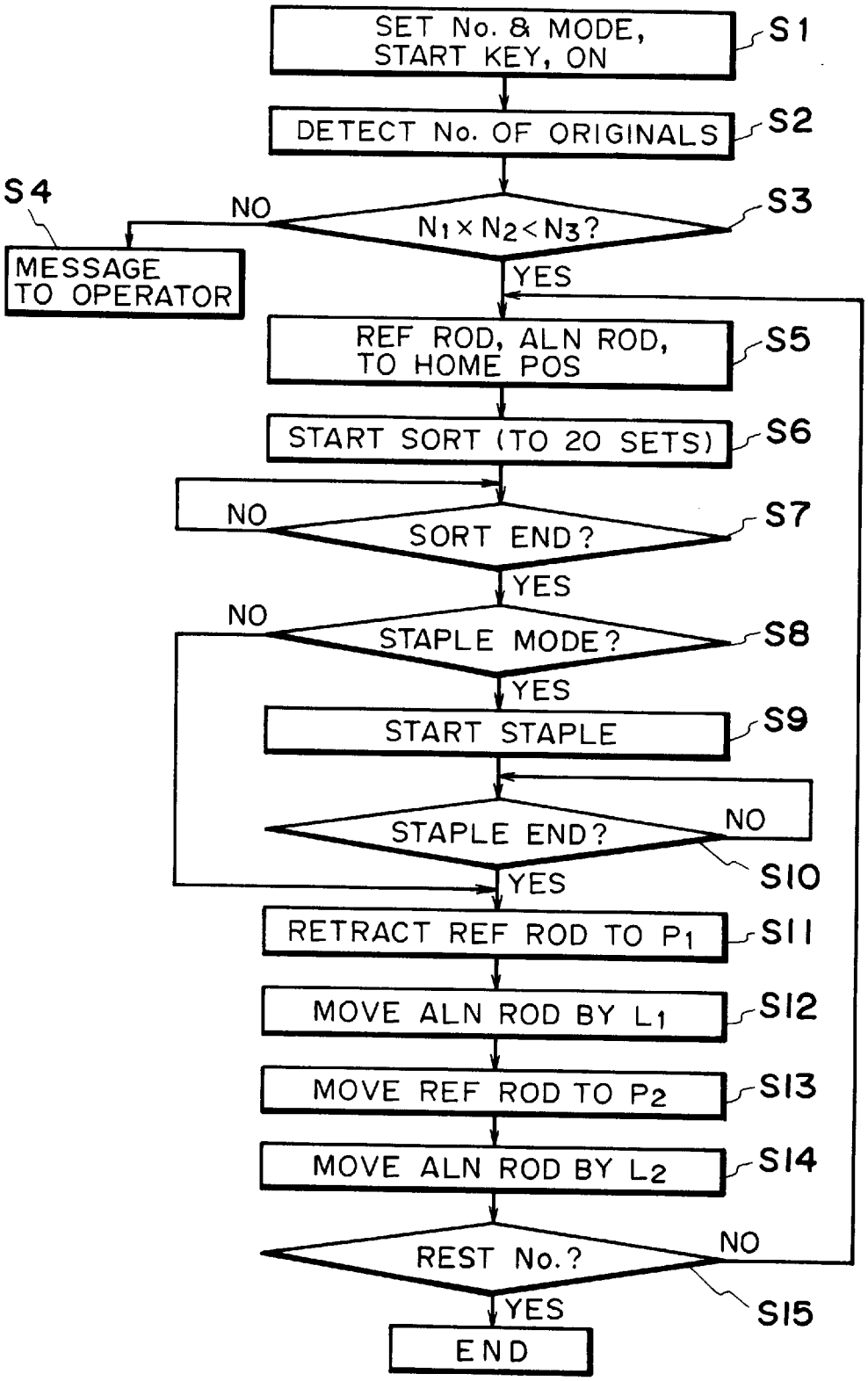
FIG. 22 is a flow chart of sequential operations.
Figure 23:
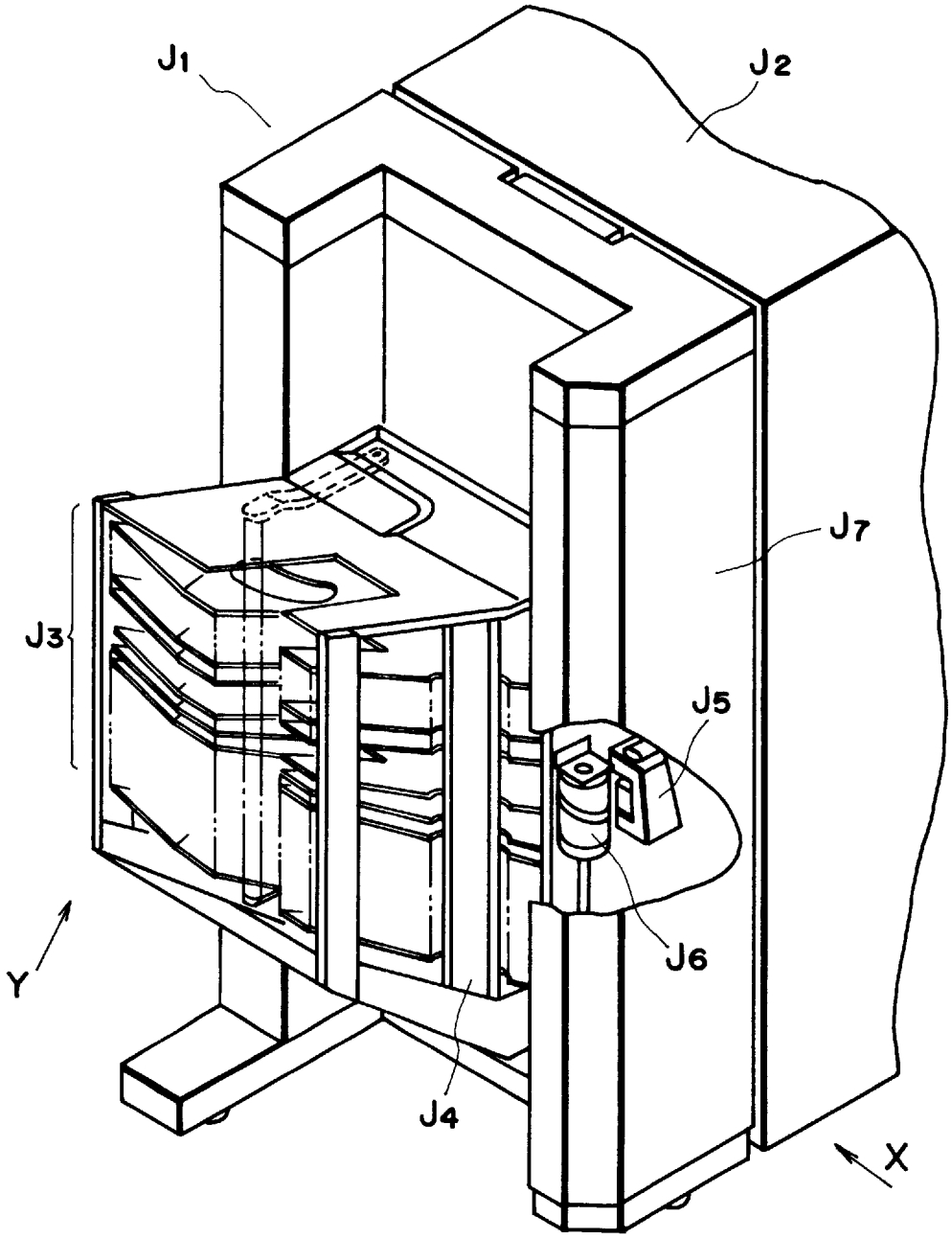
FIG. 23 PRIOR ART
FIG. 23 is a perspective view of a conventional apparatus.

In this embodiment, the advantageous effects are described with respect to a movable bin type sorter using the lead cam. However, the present invention is applicable with the same advantageous effects to a type in which the interval between adjacent bins are expanded by a link mechanism 950 as shown in FIG. 19, for example (Japanese Laid-Open patent application No. 17063/1983), a Geneva type sorter shown in FIG. 20 (Japanese Laid-Open patent application No. 223764/1985), a fixed-bin type finisher or one tray finisher (Japanese Laid-Open Utility Model Application No. 20046/1987), a sheet-post-processing station for a limitless sorter 903 as disclosed in Japanese Laid-Open patent application No. 201295/1993 which has two sorter units 900 shown in FIG. 21 and which is alternately movable between a sorting station 901 and a sheet post-processing station 902.

While the invention has been described with reference to the structures disclosed herein, it is not confined to the details set forth and this application is intended to cover such modifications or changes as may come within the purposes of the improvements or the scope of the following claims.

What is claimed is:

1. A sheet post-processing apparatus comprising:

a plurality of sheet receiving trays vertically arranged with space between adjacent ones for accommodating sheets;

sheet discharging means for discharging sheets to said plurality of sheet receiving trays;

a passage for permitting the sheet to be taken out from a front side in an inclined direction; and sheet inclining means for inclining the sheets on said sheet receiving tray to facilitate taking-out of the sheets from the passage, said sheet inclining means extending in a direction of arrangement of said plurality of trays to incline all of said sheets in said plurality of trays together.

2. An apparatus according to claim 1, further comprising means for vertically moving said plurality of sheet receiving trays, wherein a part of said means for vertically moving said plurality of sheet receiving trays is located at a front side of said apparatus.

3. An apparatus according to claim 1, wherein said sheet inclining means moves the sheets on said receiving tray in the inclined direction.

4. An apparatus according to claim 1, wherein said sheet inclining means includes shifting means for shifting the sheets on said sheet receiving tray in a direction crossing with a sheet discharging direction and moving means for rotating the sheet by pushing a part of the sheets after shifting.

5. An apparatus according to claim 4, wherein said shifting means also functions for translational movement after the sheet is inclined by said sheet moving means.

6. An apparatus according to claim 1, wherein said sheet inclining means includes shifting means for shifting the sheets on said sheet receiving tray in a direction crossing with a sheet discharging direction, moving means for rotating the sheet by pushing a part of the sheets after shift, and translating means for translating in an inclined direction after the sheets are rotated.

7. An apparatus according to claim 1, wherein said sheet inclining means includes moving means for rotating the sheet by pushing a part of the sheets after a shift, and translating means for translating in an inclined direction after the sheets are rotated.

8. An apparatus according to claim 6 or 7, further comprising translation control means for controlling a distance of the translational movement by said sheet translating means.

9. An apparatus according to claim 1, wherein said sheet inclining means includes moving means for rotating the sheet by operating on a part of the sheets.

10. An apparatus according to claim 1, further comprising means for stapling the sheets on said sheet receiving tray.

11. An apparatus according to claim 4, 6 or 7 wherein said sheet receiving tray is inclined downwardly at a sheet receiving side, and said sheet moving means penetrates through the sheet receiving trays, and is moved along inclination of said sheet receiving trays.

12. A sheet post-processing apparatus comprising:

at least one sheet receiving tray for accommodating sheets;

sheet discharging means for discharging the sheets to said sheet receiving tray;

a first sheet moving means for moving the sheets on said sheet receiving tray in a direction crossing with said sheet discharging direction;

a second sheet moving means for moving the sheets to incline them on said sheet receiving tray to permit the sheets to be taken out from a front side of said apparatus in an inclined direction, after the sheets are moved by said first sheet moving means.

13. An apparatus according to claim 12, wherein said control means operates again said first sheet moving means after the sheets are inclined to translate the sheets in an inclined direction.

14. An apparatus according to claim 13, wherein said control means controls a distance through which the translational movement is made.

15. An apparatus according to claim 12, further comprising means for translating the sheets in an inclined direction after movement by said second sheet moving means.

16. An apparatus according to claim 13 or 15, further comprising guiding means for guiding the sheets to be translated.

17. An apparatus according to claim 15, further comprising translating control means for controlling a distance of the translational movement by said translating means.

18. An apparatus according to claim 12, wherein said second sheet moving means includes means for rotating the sheets by pushing a part of the sheets.

19. An apparatus according to claim 12, wherein said first sheet moving means includes aligning means for aligning the sheets discharged to said sheet receiving tray, to a reference position one-by-one, and for moving the aligned sheets.

20. An apparatus according to claim 19, wherein said second sheet moving means also functions as reference means for the alignment, and is retracted to a retracted position when the sheets are moved.

21. An apparatus according to claim 2, wherein a plurality of such sheet receiving trays are vertically arranged with spaces between adjacent ones, and wherein a part of means for vertically moving said sheet receiving tray at a front side of said apparatus.

22. An apparatus according to claim 21, wherein said sheet receiving tray is inclined downwardly at a sheet receiving side, and said second sheet moving means penetrates through the sheet receiving trays, and is moved along inclination of said sheet receiving trays.

23. A sheet post-processing apparatus comprising:

at least one sheet receiving tray for accommodating sheets;

sheet discharging means for discharging sheets to said sheet receiving tray;

sheet moving means for moving the sheets to incline them on said sheet receiving tray to permit the sheets to be taken out from a front side of said apparatus in an inclined direction; and sheet translating means for translating the sheets in an inclined direction, after the sheets are inclined.

24. An apparatus according to claim 23, further comprising control means for controlling a distance of the translational movement by said sheet translating means.

25. An apparatus according to claim 23, further comprising means for stapling the sheets on said sheet receiving tray.

26. An apparatus according to claim 23, further comprising shifting means for shifting the sheets on said sheet receiving tray in a direction crossing with a sheet discharging direction before movement by said sheet moving means.

27. An apparatus according to claim 26, wherein said shifting means functioning as aligning means for aligning the sheets discharged to said sheet receiving tray, to a reference position one-by-one, and also functions to shift the aligned sheets.

28. An apparatus according to claim 27, wherein said sheet moving means also functions as reference means for the alignment, and is retracted to a retracted position when the sheets are shifted.

29. An apparatus according to claim 23, wherein said sheet moving means includes means for rotating the sheets by pushing a part of the sheets.

30. An apparatus according to claim 23, further comprising guiding means for guiding the sheets to be translated.

31. An apparatus according to claim 23, wherein a plurality of sheet receiving trays are vertically arranged with spaces between adjacent ones, and wherein a part of a means for vertically moving said sheet receiving tray is at a front side of said apparatus.

32. An apparatus according to claim 31, wherein said sheet receiving tray is inclined downwardly at a sheet receiving side, and said sheet moving means penetrates through the sheet receiving trays, and is moved along an inclination of said sheet receiving trays.

33. An image forming apparatus comprising:

means for forming images on sheets;

a plurality of sheet receiving trays vertically arranged with space between adjacent ones for accomodating the sheets;

sheet discharging means for discharging sheets to said plurality of sheet receiving trays;

a passage for permitting the sheets to be taken out from a front side in an inclined direction;

sheet inclining means for inclining the sheets on said sheet receiving tray to facilitate taking-out of the sheets from the passage, said sheet inclining means extending in a direction of arrangement of said plurality of trays to incline all of said sheets in said plurality of trays together.

34. An apparatus according to claim 33, further comprising an automatic document feeder for circulating originals to be copied.

35. An image forming apparatus comprising:

means for forming images on sheets;

at least one sheet receiving tray for accommodating the sheets;

sheet discharging means for discharging sheets to said sheet received tray;

a first sheet moving means for moving the sheets on said sheet receiving tray in a direction crossing with said sheet discharging direction, a second sheet moving means for moving the sheets to incline them on said sheet receiving tray to permit the sheets to be taken out from a front side of said apparatus in an inclined direction, after the sheets are moved by said first sheet moving means, and control means for moving the sheets by said second sheet moving means after movement by said first sheet moving means.

36. An apparatus according to claim 35, further comprising an automatic document feeder for circulating originals to be copied.

37. An image forming apparatus comprising:

means for forming images on sheets;

at least one sheet receiving tray for accommodating the sheets;

sheet discharging means for discharging sheets to said sheet receiving tray;

sheet moving means for moving the sheets to incline them on said sheet receiving tray to permit the sheets to be taken out from a front side of said apparatus in an inclined direction; and sheet translating means for translating the sheets in an inclined direction, after the sheets are inclined.

38. An apparatus according to claim 37, further comprising an automatic document feeder for circulating originals to be copied.

39. A apparatus according to claim 6 or 7, further comprising guiding means for guiding the sheets to be translated.

40. An apparatus according to claim 4 or 6, wherein said shifting means aligns the sheets discharged to said sheet receiving tray, to a reference position one-by-one, and also functions to shift the aligned sheets.

41. An apparatus according to claim 40, wherein said inclining means also functions as reference means for the alignment, and is retracted to a retracted position when the sheets are shifted.

* * * * *

UNITED STATES PATENT AND TRADEMARK OFFICE

CERTIFICATE OF CORRECTION

PATENT NO. : 5,836,579

DATED : November 17, 1998

INVENTOR(S) : KENICHI HAYASHI, ET AL.

It is certified that error appears in the above-identified patent and that said Letters Patent is hereby corrected as shown below:

COLUMN 5,
Line 25, "feed" should read --feeds--; and
Line 65, "whereas" should read --whereas if--.

COLUMN 10,
Line 37, "claim 2," should read --claim 12,--.

COLUMN 11,
Line 2, "functioning" should read --functions--.

Signed and Sealed this

Fourteenth Day of September, 1999

*Attest:*

Q. TODD DICKINSON

*Attesting Officer*

*Acting Commissioner of Patents and Trademarks*